US006271796B1

(12) United States Patent
Itoh et al.

(10) Patent No.: US 6,271,796 B1
(45) Date of Patent: Aug. 7, 2001

(54) BUILT-IN ANTENNA FOR RADIO COMMUNICATION TERMINALS

(75) Inventors: Hideo Itoh, Yokosuka; Kiyoshi Egawa, Oiso-machi, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/236,643

(22) Filed: Jan. 26, 1999

(30) Foreign Application Priority Data

Jan. 30, 1998 (JP) ..... 10-032401

(51) Int. Cl.[7] ..... H01Q 1/24
(52) U.S. Cl. ..... 343/702; 343/895
(58) Field of Search ..... 343/702, 741, 343/742, 866, 867, 870, 744, 700 MS, 895, 743; H01Q 1/24

(56) References Cited

U.S. PATENT DOCUMENTS 3,918,062 * 11/1975 Haruki ..... 343/702
4,571,595 * 2/1986 Phillips et al. ..... 343/745
5,422,650 * 6/1995 Hill ..... 343/713
5,451,965 9/1995 Matsumoto ..... 343/702
5,613,224 * 3/1997 Auvray ..... 343/702
5,767,809 * 6/1998 Chuang et al. ..... 343/700 MS
5,973,650 * 10/1999 Nakanishi ..... 343/742

FOREIGN PATENT DOCUMENTS 6232625 8/1994 (JP) .

OTHER PUBLICATIONS

An English Language abstract of JP 6–232625.

* cited by examiner

*Primary Examiner*—Hoanganh Le
*Assistant Examiner*—Trinh Vo Dinh
(74) *Attorney, Agent, or Firm*—Greenblum & Bernstein P.L.C.

(57) ABSTRACT

The built-in antenna for radio communication terminals of the present invention includes a loop antenna with a circumference of approximately one wavelength or less placed at an extremely short distance compared with the wavelength from the plane of the terminal board so that its loop plane may be perpendicular to the plane of said terminal bottom board which is opposite to the human body during communication, and a balanced/unbalanced conversion circuit with an impedance conversion function that supplies power to this loop antenna.

27 Claims, 22 Drawing Sheets

BUILT-IN ANTENNA FOR RADIO COMMUNICATION TERMINALS

BACKGROUND OF THE INVENTION

1. Field of the Invention

The present invention relates to built-in antennas for radio communication terminals used for portable telephones and portable terminals, etc., and especially relates to high-gain built-in antennas for radio communication terminals capable of diversity reception with less influences of the human body during communication of a radio apparatus.

2. Description of the Related Art

A conventional built-in antenna used for portable radio apparatuses has a configuration as shown in FIG. 1. FIG. 1 is a schematic drawing that shows the configuration of a conventional built-in antenna used for radio communication terminals. Each element shown in said figure is incorporated in a cabinet of the radio communication terminal, but a general view of the radio communication terminal is omitted here to simplify the explanation. As shown in said figure, the conventional radio communication terminal is provided with tabular reverse F type antenna 7 and bottom board 1. X, Y and Z indicate their respective coordinate axes.

The built-in antenna above is also used as a diversity antenna that copes effectively with variations in the strength of the received electric field due to radio wave multi-passes. FIG. 2 is a schematic drawing showing the configuration of a diversity antenna used for conventional radio communication apparatuses. As shown in FIG. 2, it has a configuration with mono-pole antenna 3 as an external antenna in addition to conventional tabular reverse F type antenna 7 above. Diversity reception is performed through two antennas, tabular reverse F type antenna 7 which is an internal antenna and mono-pole antenna 3 which is an external antenna, providing stable communications.

The tabular reverse F type antenna with the conventional configuration shown in FIG. 1 operates as an exciter that excites the radio apparatus bottom board rather than as an antenna. Therefore, an antenna current flows in the radio apparatus bottom board and the radio apparatus bottom board controls the antenna. FIG. 3 and FIG. 4 show measured values of directivity at 800 MHz for a radio apparatus bottom board of 125 mm×35 mm in size. FIG. 3 shows directivity of the horizontal plane (X-Y plane) in a free space. FIG. 3 shows almost no directivity because the radio apparatus bottom board operates as an antenna. Therefore, during communication of the radio apparatus as shown in FIG. 5, electromagnetic waves are also emitted uniformly toward the human body. FIG. 4 shows the directivity of the horizontal plane (X-Y plane) during communication of the radio apparatus as shown in FIG. 5. FIG. 4 shows that there is a problem of gain reduction due to influences of the human body.

When a portable radio apparatus is communicating, it is generally tilted approximately 60 degrees with respect to the vertical direction. That is, since the portable radio apparatus is used at an angle of $\alpha$ degrees (approximately 60 degrees) with respect to the human body during communication as shown in FIG. 5, the polarization plane of a base station antenna differs by a degrees (approximately 60 degrees) from that of the portable radio apparatus antenna, resulting in a problem that the gain is reduced due to a mismatch of the polarization plane during transmission/reception to/from the base station.

In the diversity antenna with the conventional configuration shown in FIG. 2, if tabular reverse F type antenna 7 operates as one antenna element that makes up the diversity antenna, the antenna has the same problem as that described above.

As shown above, since the conventional built-in antenna for radio communication terminals has almost no directivity within the horizontal plane, it also emits electromagnetic waves uniformly toward the human body, having the problem that the gain is reduced by influences of the human body. Therefore, how to eliminate influences of the human body is a problem for the built-in antenna for radio communication terminals. Furthermore, since the radio apparatus is used at an angle of approximately 60 degrees with respect to the human body during communication, the polarization plane of transmission/reception to/from the base station differs by approximately 60 degrees, having the problem of a gain reduction. The question is how to match its plane of polarization with that of the base station. Furthermore, in a diversity antenna for portable radio apparatuses, if the tabular reverse F type antenna above operates as one antenna element that makes up the diversity antenna, it has the same problem as that shown above. The present invention is intended to solve these problems.

SUMMARY OF THE INVENTION

In order to solve the problems above, the present invention provides a built-in antenna for radio communication terminals comprising a loop antenna with a circumference of approximately one wavelength or less placed at an extremely short distance compared with the wavelength from the plane of the radio apparatus bottom board so that the loop plane may be perpendicular to the radio apparatus bottom board which is opposite to the human body during communication, and a balanced/unbalanced conversion circuit that supplies power to said loop antenna after impedance conversion. Such a configuration provides a match between the antenna and transmission circuit, minimizes an antenna current that flows into the radio apparatus bottom board from the balanced/unbalanced conversion circuit, makes the radio apparatus bottom board operate as a reflector and provides the plane of the radio apparatus bottom board with directivity toward the antenna installation which is opposite to the human body, implementing a high-gain antenna with less influences of the human body during communication.

Furthermore, the present invention has a configuration with the longitudinal direction of the loop plane of the loop antenna placed at an angle of approximately 60 degrees with respect to the major axis direction of the radio apparatus bottom board plane so that the longitudinal direction of the loop plane may be perpendicular to the ground during communication. This configuration allows the polarization plane of transmission waves or reception waves to match that of the base station during communication, achieving a high-gain antenna by preventing a gain reduction due to a mismatch of the polarization plane with that of the base station.

In addition, the present invention has a configuration with the loop plane longitudinal element of the loop antenna bent. This configuration increases the vertical polarization component, allowing two polarized waves, horizontal and vertical, to be transmitted/received.

The present invention also has a configuration with one end or both ends of the loop plane longitudinal element of the loop antenna provided with a bottom board. Such a configuration allows the resonance frequency of the antenna to be reduced, making it possible to equivalently reduce the size of the antenna and implement a wideband antenna.

Furthermore, the present invention adopts a configuration using a reception-only loop antenna as one antenna element that makes up the diversity antenna, and a mono-pole antenna used for reception and transmission as the other antenna element. Such a configuration implements a high-gain diversity antenna with less influences of the human body.

In addition, the present invention adopts a configuration using a loop antenna as one reception antenna element of the diversity antenna with the loop plane longitudinal element bent. Such a configuration allows two polarized waves to be received during diversity operation.

DETAILED DESCRIPTION OF THE PREFERRED EMBODIMENTS

With reference now to FIG. 6 to FIG. 46, the embodiments of the present invention are explained in detail below.

(Embodiment 1)

A first embodiment of the present invention is a built-in antenna for radio communication terminals that has a loop antenna with a circumference of approximately one wavelength or less placed at an extremely short distance compared with the wavelength from the plane of the radio apparatus bottom board, with its loop plane set perpendicular to the plane of the radio apparatus bottom board which is opposite to the human body and supplies power via a balanced/unbalanced conversion circuit.

Figure 6:
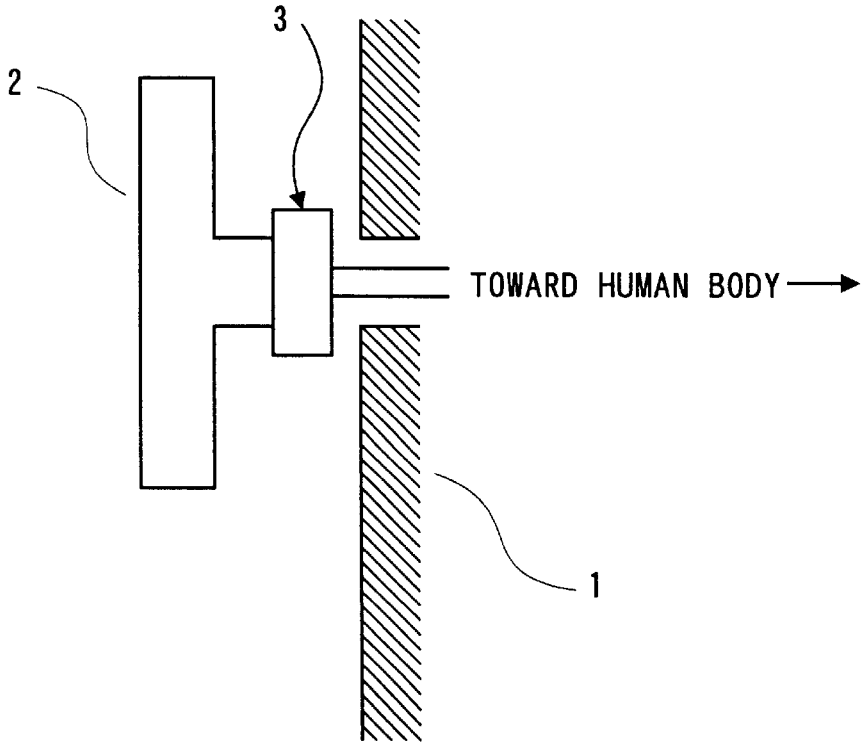
FIG. 6 illustrates a block diagram of a built-in antenna for radio communication terminals according to Embodiment 1 of the present invention.
Figure 7:
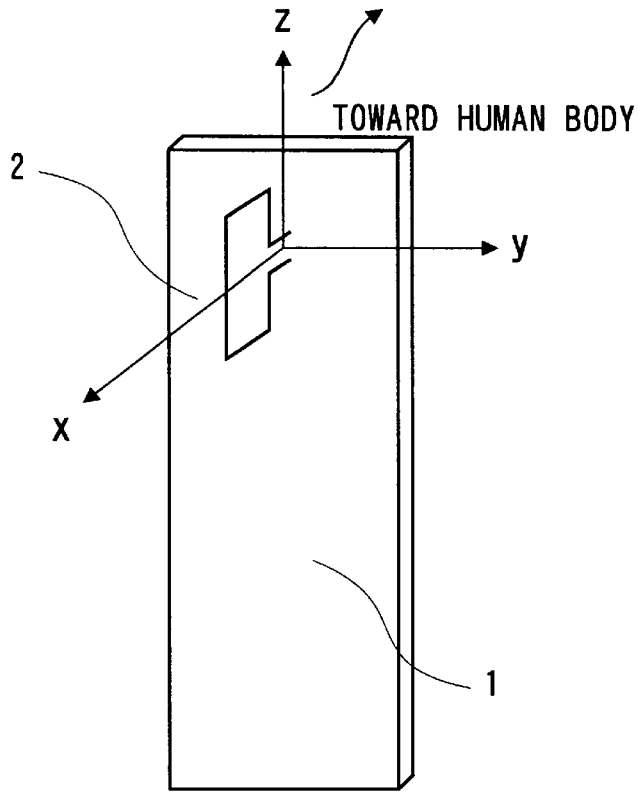
FIG. 7 illustrates a layout drawing of the built-in antenna for radio communication terminals according to Embodiment 1 of the present invention.

FIG. 6 illustrates a block diagram showing the configuration of the built-in antenna for radio communication terminals according to Embodiment 1 of the present invention. FIG. 7 is a layout drawing of the radio apparatus bottom board and loop antenna. Each element in said figure is incorporated in the cabinet of a radio communication terminal, but a general view of the radio communication terminal is omitted to simplify the explanation. The built-in antenna for radio communication terminals according to the present embodiment comprises bottom board 1, loop antenna 2 and balanced/unbalanced conversion circuit 3. X, Y and Z indicate their respective coordinate axes. Each component is explained below.

Figure 1:
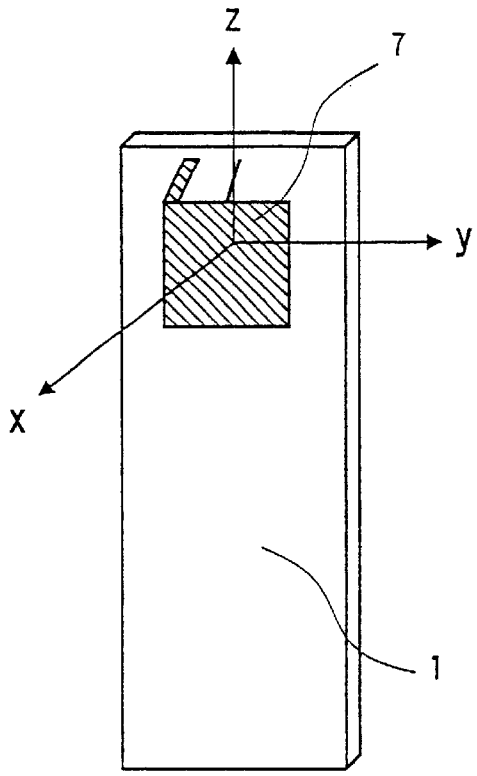
PRIOR ART FIG. 1
FIG. 1 illustrates a block diagram of a conventional built-in antenna for radio communication terminals.

In FIG. 6 and FIG. 7, 1 represents the radio apparatus bottom board which is a tabular ground conductor and is attached virtually parallel to the plane (vertical plane) of the radio communication terminal on which operation buttons, a display and speaker, etc. which are not shown in the figure are provided. 2 represents the loop antenna and 3 represents the balanced/unbalanced conversion circuit. Loop antenna 2 is a loop antenna with a circumference of approximately one wavelength or less, placed at an extremely short distance compared with the wavelength from the plane of the radio apparatus bottom board, with its loop plane set perpendicular to the plane of the radio apparatus bottom board which is opposite to the human body when the radio apparatus is communicating. Balanced/unbalanced conversion circuit 3 is a conversion circuit provided at the feeding end of the loop antenna, with an impedance conversion ratio of 1:1 or n:1 (n: integer). X, Y and Z represent their respective coordinate axes.

Impedance conversion of the balanced/unbalanced conversion circuit makes it easier for this loop antenna to find impedance matching between the antenna and transmission/reception circuit. Furthermore, since it converts an unbalanced signal of the transmission circuit to a balanced signal and supplies it to the antenna, the antenna current that flows into the radio apparatus bottom board is minimized so that the radio apparatus bottom board operates as a reflector. As a result, it provides directivity in the direction in which the antenna is installed, opposite to the human body with respect to the plane of the radio apparatus bottom board, thus achieving a high-gain antenna with less influences of the human body when the radio apparatus is communicating.

Figure 8:
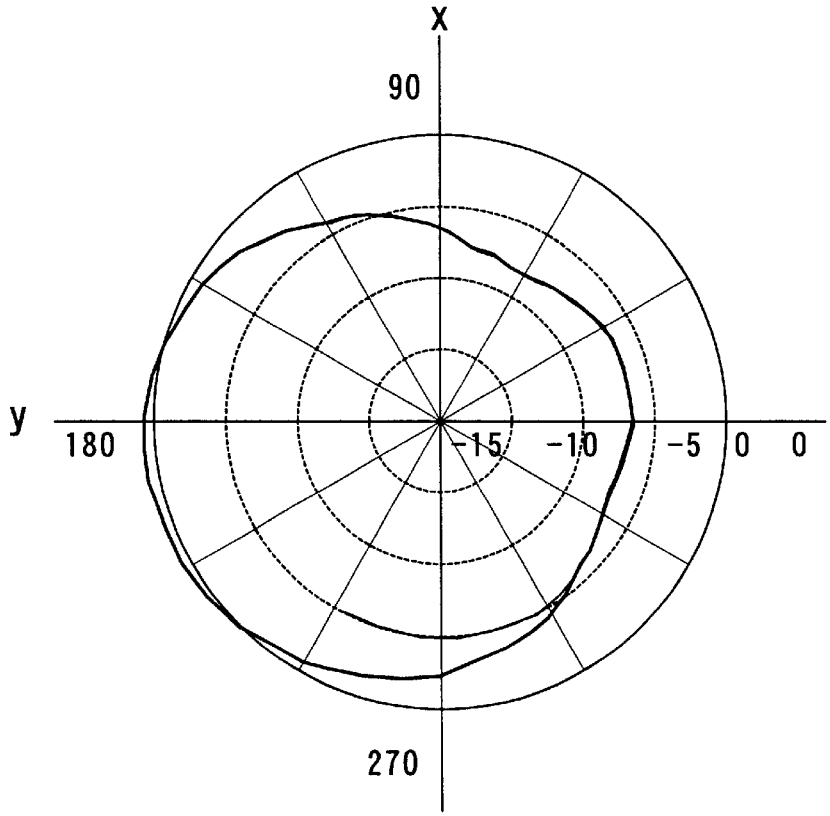
FIG. 8 illustrates the directivity in a free space of the built-in antenna for radio communication terminals according to Embodiment 1 of the present invention.
Figure 9:
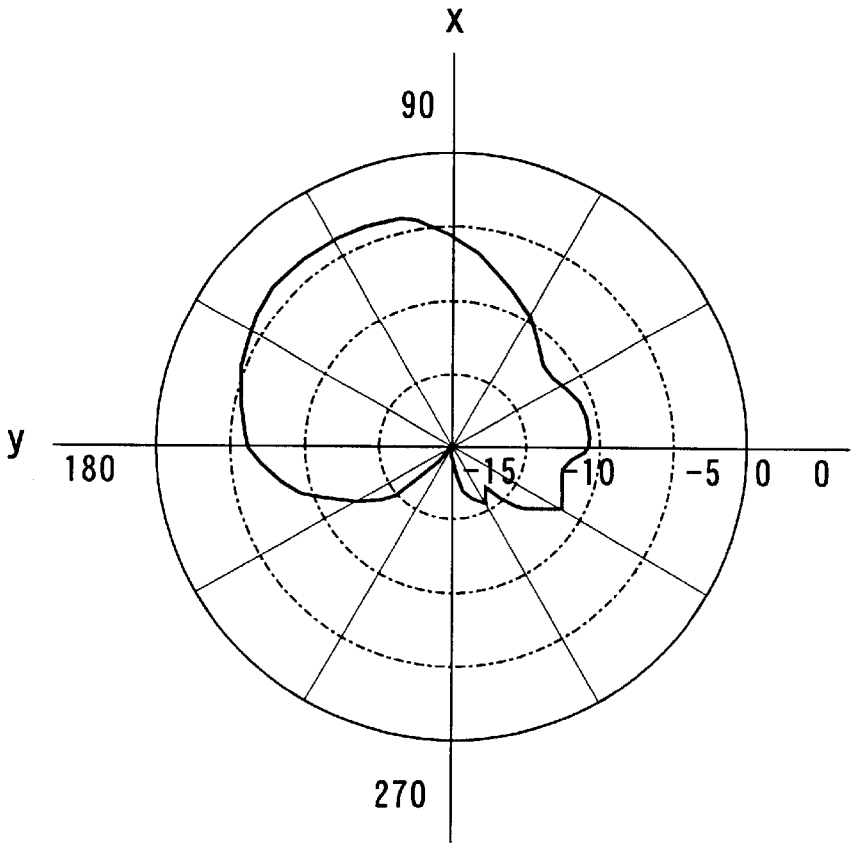
FIG. 9 illustrates the directivity of the built-in antenna for radio communication terminals according to Embodiment 1 of the present invention when carried with a radio apparatus.

FIG. 8 shows the directivity of the free space horizontal plane (X-Y plane) at 2 GHz in the case of the radio apparatus bottom board of 125 mm×30 mm in size and the distance of the loop antenna from the radio apparatus bottom board of 3 mm and the distance between the plane of the radio apparatus bottom board. From FIG. 8, it is clear that the directivity exists in the direction in which the antenna is installed (X-axis direction) which is opposite to the human body with respect to the plane of the radio apparatus bottom board. FIG. 9 shows the directivity of the horizontal plane (X-Y plane) when the radio apparatus is communicating. This gives an understanding that the radio apparatus bottom board operates as a reflector, achieving a high-gain antenna with less influences of the human body.

As shown above, the built-in antenna for radio communication terminals according to the first embodiment of the present invention has a loop antenna with a circumference of approximately one wavelength or less placed at an extremely short distance compared with the wavelength from the plane of the radio apparatus bottom board, with its loop plane set perpendicular to the plane of the radio apparatus bottom board which is opposite to the human body and supplies power via a balanced/unbalanced conversion circuit, which causes the radio apparatus bottom board to operate as a reflector, implementing an antenna having directivity in the direction in which the antenna is installed which is opposite to the human body with respect to the plane of the radio apparatus bottom board.

Furthermore, this antenna finds impedance matching between the antenna and transmission/reception circuit, minimizes the antenna current flowing into the radio apparatus bottom board by the balanced/unbalanced conversion circuit, makes the radio apparatus bottom board operate as a reflector and has directivity in the direction in which the antenna is installed which is opposite to the human body with respect to the plane of the radio apparatus bottom board.

(Embodiment 2)

A second embodiment of the present invention is a built-in antenna for radio communication terminals, wherein the loop plane longitudinal direction of the loop antenna is tilted approximately 60 degrees from the main axis direction of a radio apparatus bottom board, with the longitudinal direction of the loop plane set perpendicular to the ground when the radio apparatus is communicating.

Figure 10:
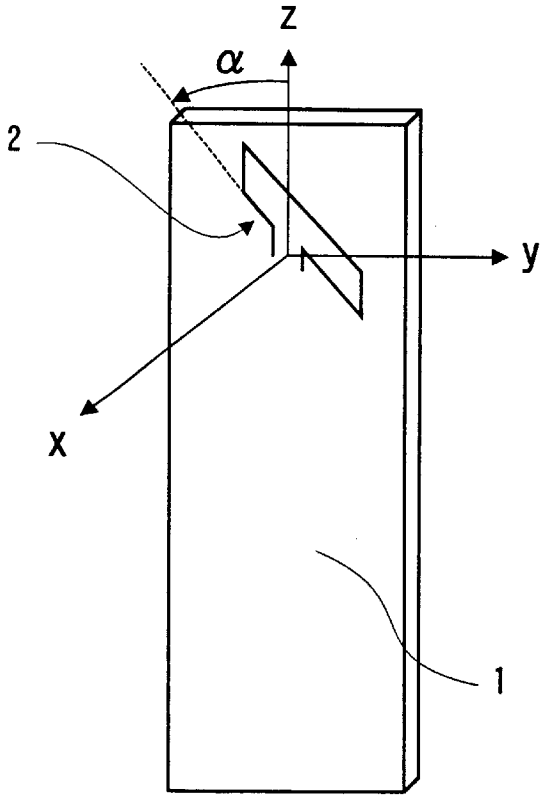
FIG. 10 illustrates a layout drawing of a built-in antenna for radio communication terminals according to Embodiment 2 of the present invention.

FIG. 10 is a layout drawing of the antenna according to the second embodiment of the present invention. X, Y and Z represent their respective coordinate axes. In FIG. 10, 1 represents the radio apparatus bottom board and 2 represents the loop antenna. Loop antenna 2 is placed with the longitudinal direction of the loop plane tilted approximately 60 degrees from the major axis direction of the radio apparatus bottom board (Z-axis direction). It is common practice that portable radio apparatuses when communicating are used tilted approximately 60 degrees from the direction perpendicular to the ground as shown in FIG. 10. Placing the loop antenna as shown in FIG. 10 allows the antenna polarization plane on the base station side to match the antenna polarization plane of the radio apparatus.

Figure 11:
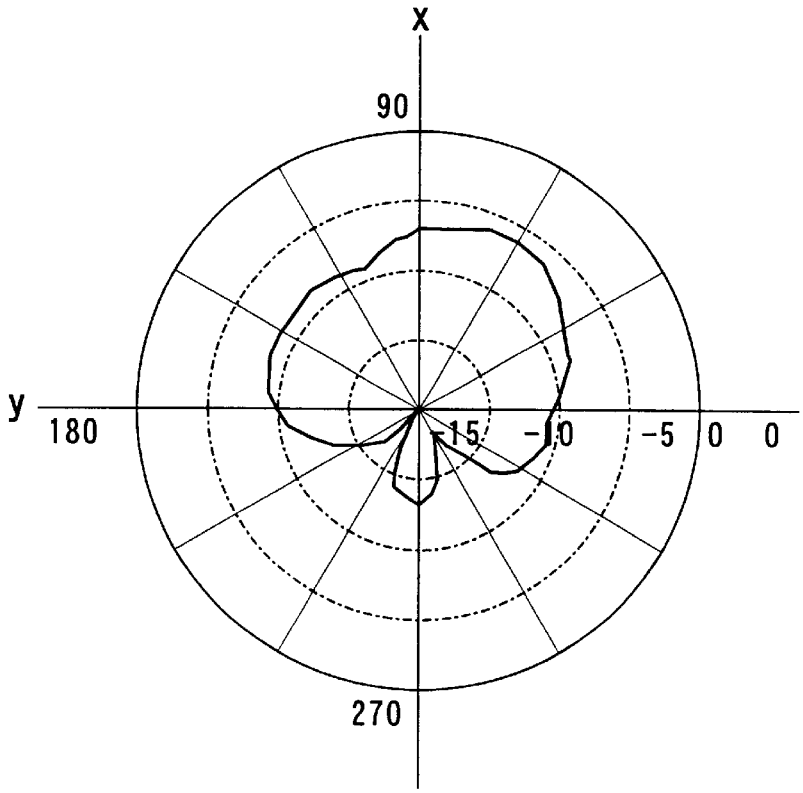
FIG. 11 illustrates the free space directivity when the polarization plane of the built-in antenna for radio communication terminals according to Embodiment 2 of the present invention differs by 60 degrees.
Figure 12:
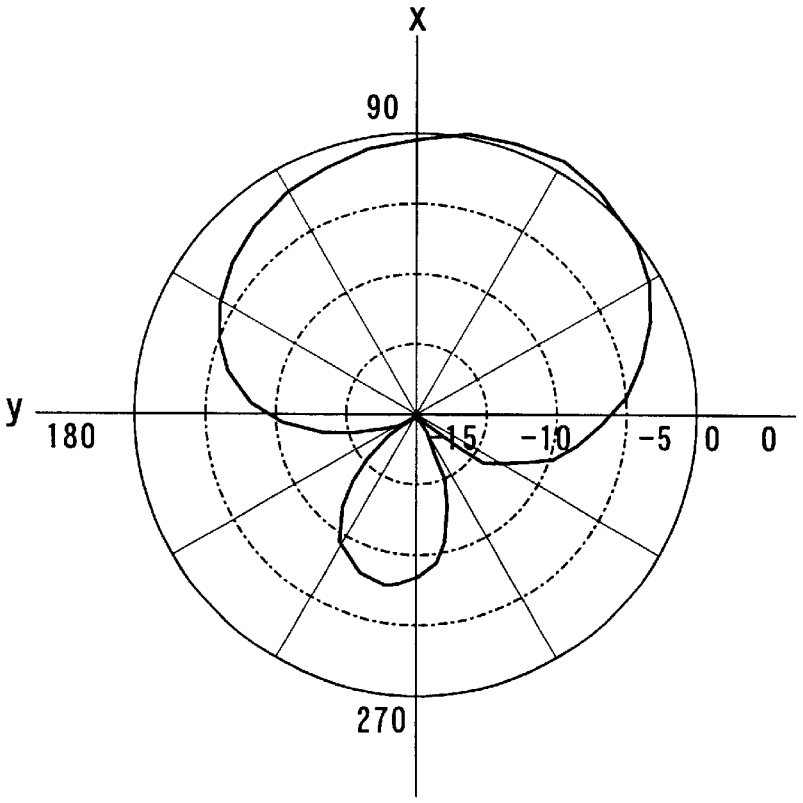
FIG. 12 illustrates the free space directivity when the polarization plane of the built-in antenna for radio communication terminals according to Embodiment 2 of the present invention matches.

FIG. 11 and FIG. 12 show the directivity of the free-space horizontal plane (X-Y plane) at 2 GHz in the case of the radio apparatus bottom board of 125 mm×30 mm in size and the loop antenna of 30 mm×5 mm, the distance of the loop antenna from the radio apparatus bottom board plane of 3 mm, with the radio apparatus bottom board tilted approximately 60 degrees from the direction perpendicular to the ground. FIG. 11 shows the directivity when the longitudinal direction of the loop plane of the loop antenna is placed in the major axis direction of the radio apparatus (Z-axis direction). FIG. 12 shows the directivity when the longitudinal direction of the loop plane of the loop antenna is placed tilted approximately 60 degrees from the major axis direction (Z-axis direction). FIG. 11 shows the directivity on the horizontal plane when the polarization plane is tilted approximately 60 degrees. FIG. 12 shows the directivity on the horizontal plane when the polarization plane is not tilted. As clearly seen from FIG. 11 and FIG. 12, finding a match with the transmission side without tilting the polarization plane achieves a gain improvement of approximately 6 dB.

As shown above, the built-in antenna for radio communication terminals according to the second embodiment of the present invention has the longitudinal direction of the loop plane of the loop antenna placed tilted approximately 60 degrees from the major axis direction of the plane of the radio apparatus bottom board, perpendicular to the ground when the radio apparatus is communicating, which allows its polarization plane to match that of the base station during communication, preventing a gain reduction due to a mismatch of the polarization plane with that of the base station, thus achieving a high-gain antenna.

(Embodiment 3)

A third embodiment of the present invention is a built-in antenna for radio communication terminals which incorporates a reactance element in the middle of the loop antenna element.

Figure 2:
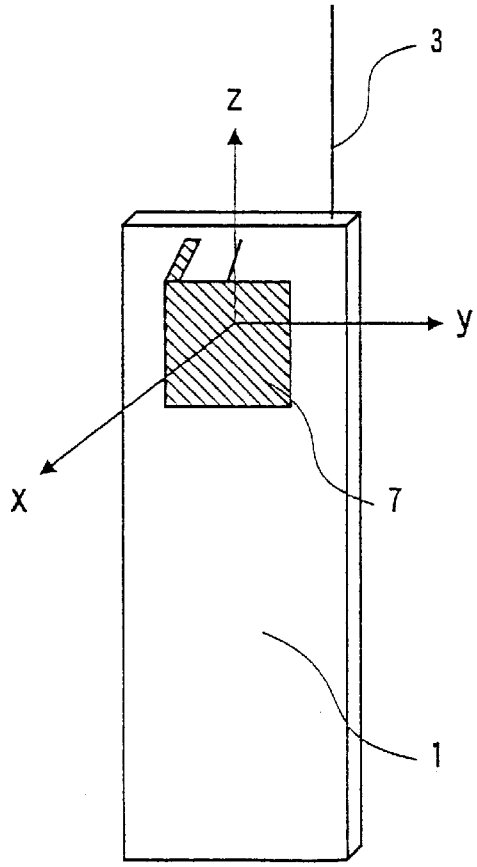
PRIOR ART FIG. 2
FIG. 2 illustrates a block diagram of a conventional diversity antenna for portable radio apparatuses.
Figure 3:
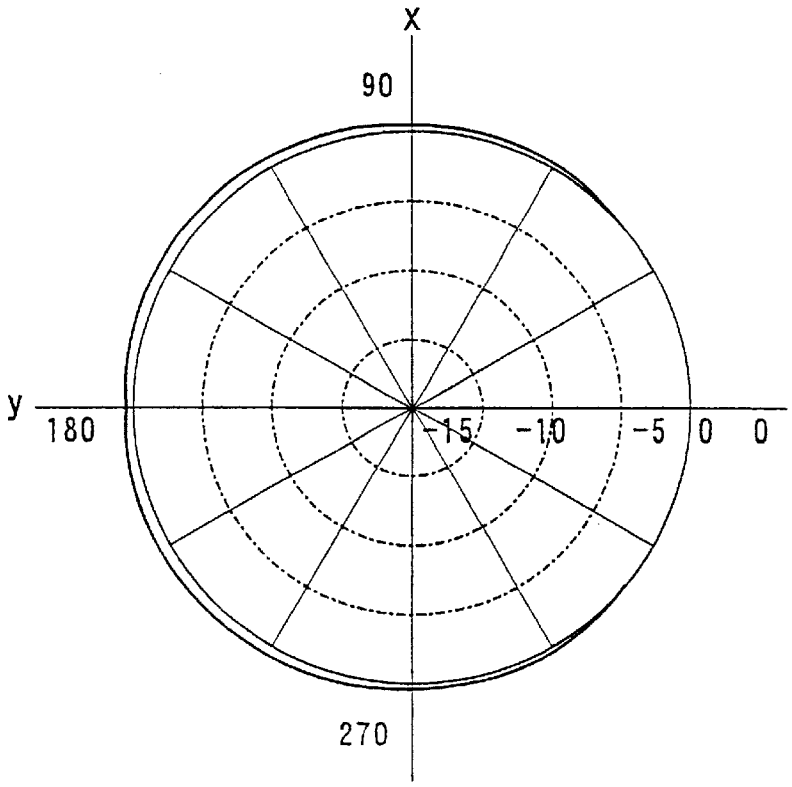
PRIOR ART FIG. 3
FIG. 3 illustrates the directivity in a free space of a conventional built-in antenna for radio communication terminals.
Figure 4:
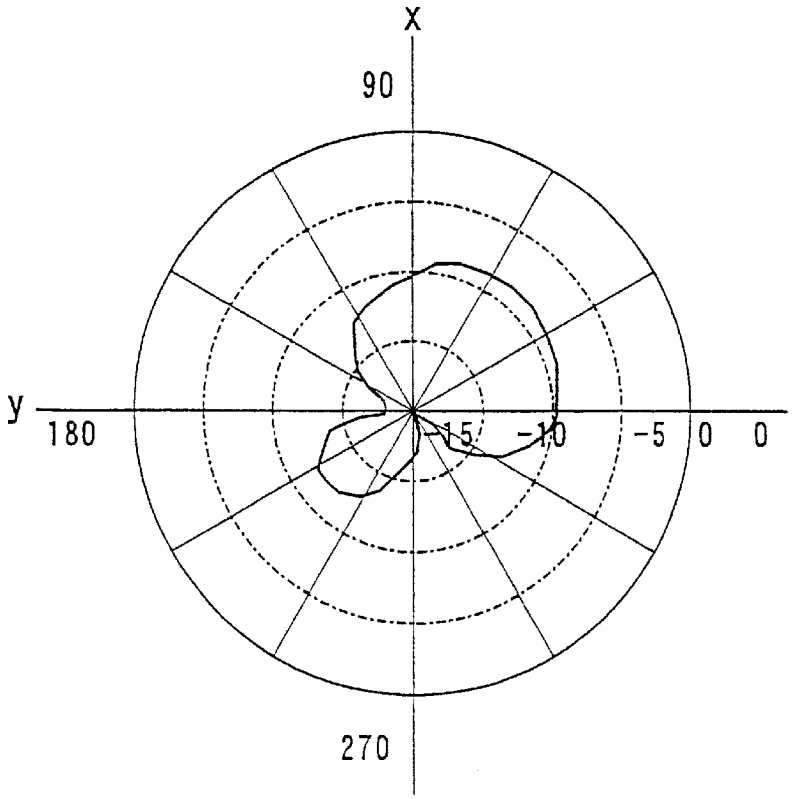
PRIOR ART FIG. 4
FIG. 4 illustrates the directivity of a conventional built-in antenna for radio communication terminals when carried with a radio apparatus.
Figure 5:
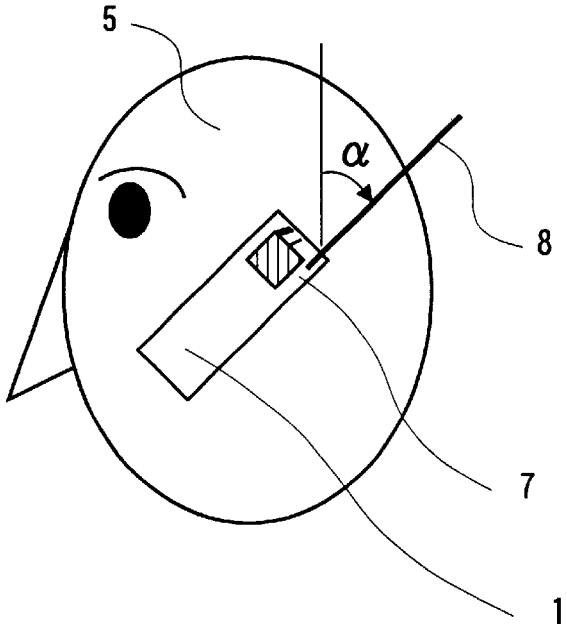
FIG. 5 illustrates a case where a radio apparatus is carried.
Figure 13:
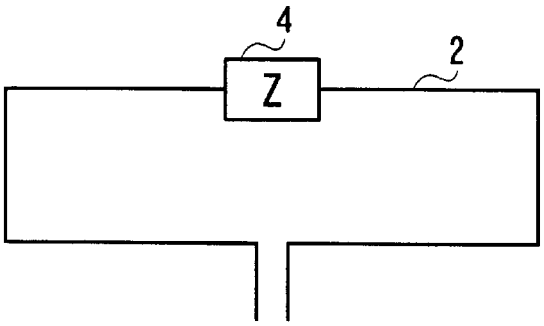
FIG. 13 illustrates a block diagram of a built-in antenna for radio communication terminals according to Embodiment 3 of the present invention.
Figure 14:
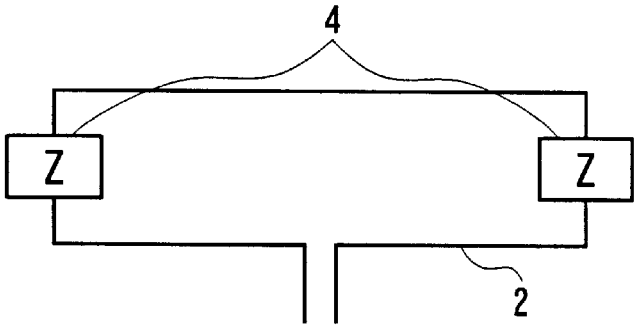
FIG. 14 illustrates a block diagram of a built-in antenna for radio communication terminals according to Embodiment 3 of the present invention.

FIG. 13 and FIG. 14 are block diagrams of the built-in antenna for radio communication terminals according to the third embodiment of the present invention. In FIG. 13 and FIG. 14, 2 represents the loop antenna element and 4 represents a reactance element inserted in the middle of the loop antenna element. FIG. 13 shows a case where a reactance element is inserted at a midpoint (opposite to the feeding end) and FIG. 14 shows another case where reactance elements are inserted between the feeding end and the midpoint of the loop antenna.

Inserting reactance elements at a midpoint of the loop antenna element allows the impedance at the feeding end of the loop antenna to change by changing the current distribution of the antenna. Even if a smaller loop antenna is used, the reactance element allows the impedance to be controlled making it possible to obtain an impedance characteristic equivalent to that of a large loop antenna, reducing the size of the loop antenna. Furthermore, changing the position at which the reactance element is inserted or changing the size of reactance of the reactance element will change impedance, emission pattern and resonance condition at the feeding end, and thus controlling the conditions for inserting the reactance element makes it possible to implement a wideband loop antenna.

As shown above, the built-in antenna for radio communication terminals according to the third embodiment of the present invention inserts reactance elements at a midpoint of the loop antenna element, making it possible to change the impedance of the loop antenna. This antenna can also reduce the size of the loop antenna or provide wider bands.

(Embodiment 4)

A fourth embodiment of the present invention is a built-in antenna for radio communication terminals with a variable capacitative element inserted at the feeding end of a loop antenna.

Figure 15:
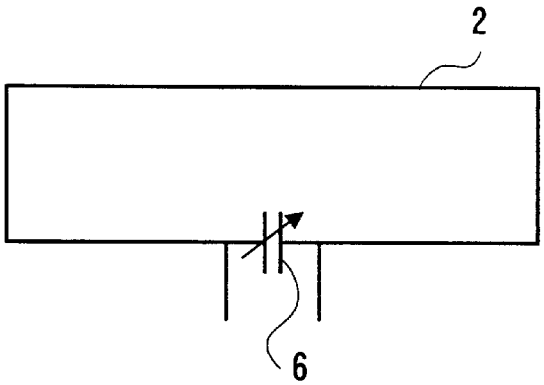
FIG. 15 illustrates a block diagram of a built-in antenna for radio communication terminals according to Embodiment 4 of the present invention.

FIG. 15 a block diagram of the built-in antenna for radio communication terminals according to the fourth embodiment of the present invention. In FIG. 15, 2 represents the loop antenna element and 6 represents a variable capacitative element provided at the feeding end of the loop antenna.

The reactance component of impedance of the loop antenna with a circumference of approximately half the wavelength or less is inductive. Inserting a variable capacitative element at the feeding end of said loop antenna and changing the inserted capacitance allow the antenna impedance to match in a certain range. Controlling the variable capacitance of a small antenna also allows impedance matching for a wide range of frequencies, implementing a wideband antenna.

As shown above, the built-in antenna for radio communication terminals according to the fourth embodiment of the present invention inserts a variable capacitative element at the feeding end of the loop antenna, realizing impedance matching by changing the capacitance of the variable capacitative element, thus implementing a small but wideband antenna.

(Embodiment 5)

A fifth embodiment of the present invention is a built-in antenna for radio communication terminals that tunes for each frequency band with one or a plurality of circuits made up of a tuning element and a switching element inserted in parallel at the feeding end of the loop antenna and by switching frequency bands with each switching element.

Figure 16:
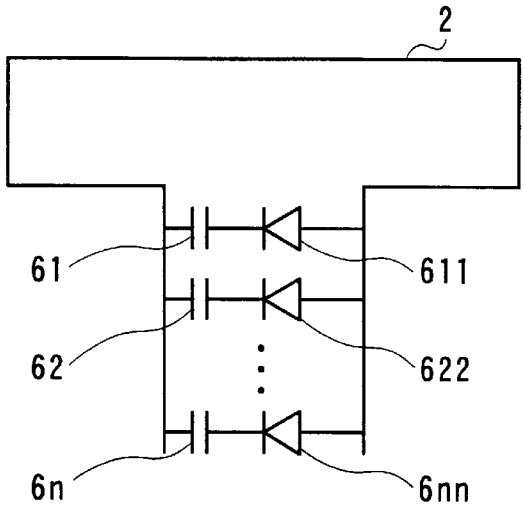
FIG. 16 illustrates a block diagram of a built-in antenna for radio communication terminals according to Embodiment 5 of the present invention.

FIG. 16 is a block diagram of the built-in antenna for radio communication terminals according to the fifth embodiment of the present invention. In FIG. 16, 2 represents the loop antenna element, 61, 62 and **6*n* represent tuning elements inserted at the end of the loop antenna, and 611, 622 and 6*nn*** represent switching elements inserted at the end of the loop antenna.

One or a plurality of circuits made up of a tuning element and a switching element are inserted in parallel at the feeding end of the loop antenna. When all switching elements are closed, the loop antenna can be used at its original tuning frequency. Closing only one switching element means inserting the corresponding tuning element in parallel, resulting in tuning of a frequency different from the original tuning frequency. Closing a plurality of switching elements means inserting the corresponding tuning elements in parallel, resulting in tuning of the frequencies corresponding to the connected tuning elements. Switching frequency bands by switching each switching element allows tuning for each frequency band, thus implementing a small but wideband antenna.

As shown above, the built-in antenna for radio communication terminals according to the fifth embodiment of the present invention inserts one or a plurality of circuits made up of a tuning element and switching element in parallel at the feeding end of the loop antenna allowing tuning for each frequency band by switching frequency bands by switching each switching element, realizing impedance matching for each frequency band. This antenna also achieves a small but wideband antenna.

(Embodiment 6)

A sixth embodiment of the present invention is a built-in antenna for radio communication terminals that configures some elements or the whole of the loop antenna in a zigzag form.

Figure 17:
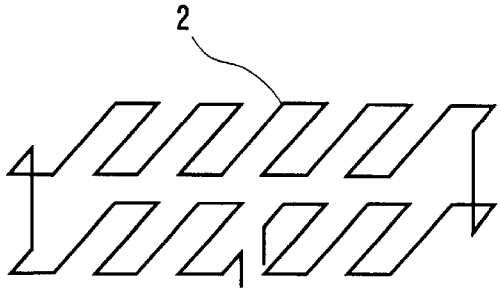
FIG. 17 illustrates a block diagram of a built-in antenna for radio communication terminals according to Embodiment 6 of the present invention.

FIG. 17 is a block diagram of the built-in antenna for radio communication terminals according to the sixth embodiment of the present invention. In FIG. 17, 2 represents a loop antenna element. Configuring some elements or the whole of the loop antenna in a zigzag form equivalently implements a small antenna.

As shown above, the built-in antenna for radio communication terminals according to the sixth embodiment of the present invention adopts a zigzag configuration for some elements or the whole of the loop antenna, making it possible to implement a small antenna.

(Embodiment 7)

A seventh embodiment of the present invention is a built-in antenna for radio communication terminals configuring some elements or the whole of the loop antenna in a tabular form.

Figure 18:
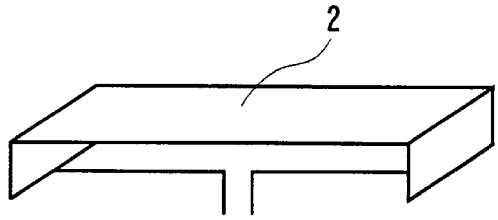
FIG. 18 illustrates a block diagram of a built-in antenna for radio communication terminals according to Embodiment 7 of the present invention.

FIG. 18 is a block diagram of the built-in antenna for radio communication terminals according to the seventh embodiment of the present invention. In FIG. 18, 2 represents a loop antenna element. Some elements or the whole of the loop antenna is made in a tabular form. Changing the form of an antenna element from linear to tabular reduces changes by frequency of the antenna impedance, making it possible to implement a wideband antenna.

As shown above, the built-in antenna for radio communication terminals according to the seventh embodiment of the present invention adopts a tabular configuration for some elements or the whole of the loop antenna, making it possible to implement a wideband antenna.

(Embodiment 8)

An eighth embodiment of the present invention is a built-in antenna for radio communication terminals with a helical di-pole antenna whose diameter is 0.1 wavelength or less instead of a loop antenna placed close to the radio apparatus bottom board.

Figure 19:
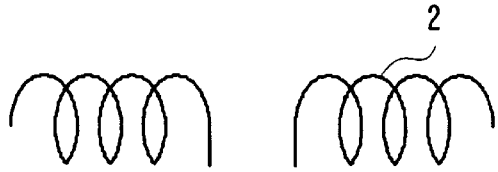
FIG. 19 illustrates a block diagram of a built-in antenna for radio communication terminals according to Embodiment 8 of the present invention.

FIG. 19 is a block diagram of the built-in antenna for radio communication terminals according to the eighth embodiment of the present invention. In FIG. 19, 2 represents a helical di-pole antenna element. Placing a helical di-pole antenna whose diameter is 0.1 wavelength or less instead of a loop antenna close to the radio apparatus bottom board opposite to the human body during communication, supplying power through a balanced/unbalanced conversion circuit with an impedance conversion function and operating it as a magnetic current antenna will provide directivity in the direction opposite to the human body during communication, thus implementing a small antenna with a function virtually equivalent to a loop antenna with a circumference of 1 wavelength or less with its loop plane set perpendicular to the plane of the radio apparatus bottom board.

Furthermore, placing the di-pole antenna approximately 60 degrees tilted from the major axis direction of the plane of the radio apparatus bottom board with the longitudinal direction of the helical di-pole antenna set perpendicular to the ground during communication allows efficient transmission/reception of vertically polarized waves during communication, thus reducing a gain reduction due to a mismatch of the polarization plane with that of the base station during communication.

As shown above, since the built-in antenna for radio communication terminals according to the eighth embodiment of the present invention has a helical di-pole antenna whose diameter is 0.1 wavelength or less placed close to the radio apparatus bottom board instead of a loop antenna, it can implement a small antenna with a function virtually equivalent to that of a loop antenna.

(Embodiment 9)

A ninth embodiment of the present invention is a diversity antenna for portable radio apparatuses using a loop antenna with directivity opposite to the human body as one reception-only antenna element that makes up the diversity antenna and a transmission/reception mono-pole antenna as the other antenna element.

Figure 20:
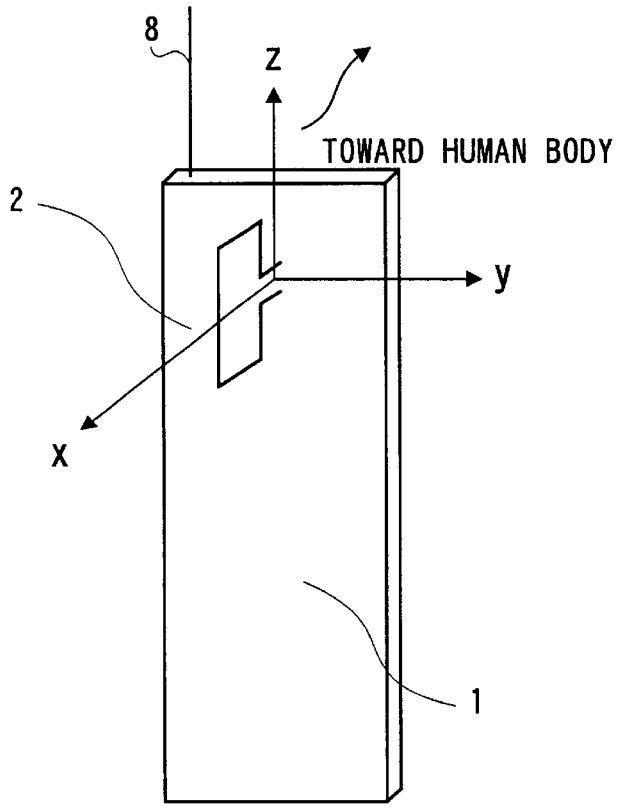
FIG. 20 illustrates a layout drawing of a built-in antenna for radio communication terminals according to Embodiment 9 of the present invention.

FIG. 20 is a layout drawing of the diversity antenna for portable radio apparatuses according to the ninth embodiment of the present invention. In FIG. 20, 1 represents a radio apparatus bottom board and 2 represents one antenna element that makes up the diversity antenna. It is a loop antenna with a circumference of approximately one wavelength or less with its loop plane set perpendicular to the plane of the radio apparatus bottom board which is opposite to the human body (X-axis direction). 8 represents a mono-pole antenna which is the other antenna element that makes up the diversity antenna. X, Y and Z represent their respective coordinate axes.

Loop antenna 2 described in the first embodiment is used as one antenna element that makes up the diversity antenna for reception only. Mono-pole antenna 8 for both transmission and reception is used as the other antenna element. During transmission only mono-pole antenna 8 functions. During reception, mono-pole antenna 8 and loop antenna 2 function and perform diversity operation. Loop antenna 2 of the first embodiment has directivity opposite to the human body during communication, thus realizing a high-gain diversity antenna without influences of the human body during communication.

As shown above, the diversity antenna for portable radio apparatuses according to the ninth embodiment of the present invention uses a loop antenna with directivity opposite to the human body as one reception-only antenna element, and thus the radio apparatus bottom board operates as a reflector during diversity operation, thus implementing a high-gain diversity antenna with less influences of the human body when the radio apparatus is communicating.

(Embodiment 10)

A tenth embodiment of the present invention is a diversity antenna for portable radio apparatuses using a loop antenna with the longitudinal direction of the loop plane set perpendicular to the ground when the radio apparatus is communicating as one reception-only antenna element that makes up the diversity antenna and using a transmission/reception mono-pole antenna as the other antenna element.

Figure 21:
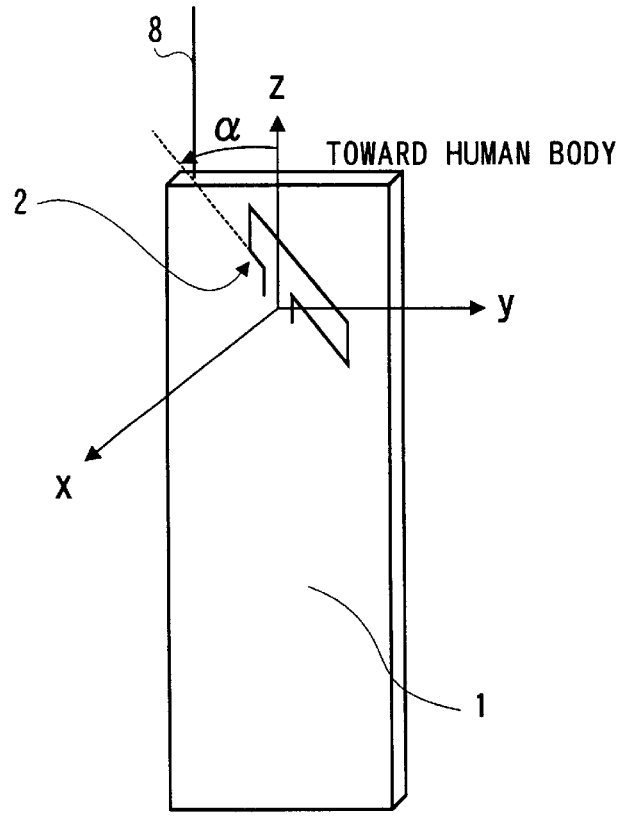
FIG. 21 illustrates a layout drawing of a built-in antenna for radio communication terminals according to Embodiment 10 of the present invention.

FIG. 21 is a layout drawing of the diversity antenna for portable radio apparatuses according to the tenth embodiment of the present invention. In FIG. 21, 1 represents a radio apparatus bottom board and 2 represents one antenna element that makes up the diversity antenna. It is a loop antenna with the longitudinal direction of the loop plane of the antenna tilted approximately 60 degrees from the major axis direction of the radio apparatus bottom board (Z-axis direction). 8 represents a mono-pole antenna which is the other antenna element that makes up the diversity antenna. X, Y and Z represent their respective coordinate axes.

Loop antenna 2 described in the first embodiment is used as one reception-only antenna element that makes up the diversity antenna. Mono-pole antenna 8 for both transmission and reception is used as the other antenna element. During transmission, only mono-pole antenna 8 functions.

During reception, mono-pole antenna 8 and loop antenna 2 function and perform diversity operation. In loop antenna 2, the longitudinal direction of the loop plane of the antenna is virtually perpendicular to the ground during communication, and thus its polarization plane matches vertically polarized waves of the base station. In diversity operation during communication, it prevents a gain reduction due to a mismatch of the polarization plane, thus implementing a high-gain diversity antenna.

As shown above, the diversity antenna for portable radio apparatuses according to the tenth embodiment of the present invention uses a tilted loop antenna as one reception-only antenna element, allowing the polarization plane to match that of the base station during communication reception, thus preventing a gain reduction and implementing a high-gain diversity antenna.

(Embodiment 11)

An eleventh embodiment of the present invention is a diversity antenna for portable radio apparatuses using a tilted loop antenna as one transmission/reception antenna element that makes up the diversity antenna and using a reception-only loop antenna as the other antenna element.

Figure 22:
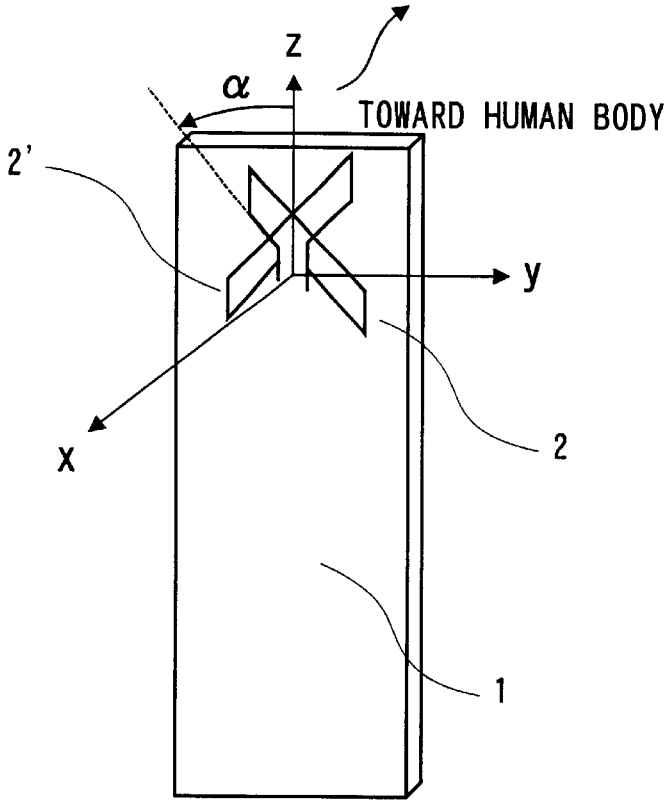
FIG. 22 illustrates a layout drawing of a built-in antenna for radio communication terminals according to Embodiment 11 of the present invention.

FIG. 22 is a layout drawing of the diversity antenna for portable radio apparatuses according to the eleventh embodiment of the present invention. In FIG. 22, 1 represents a radio apparatus bottom board and 2 represents one antenna element that makes up the diversity antenna. This antenna element is a loop antenna with the longitudinal direction of the loop plane of the antenna tilted approximately 60 degrees from the major axis direction of the radio apparatus bottom board (Z-axis direction). 2' represents a loop antenna similar to loop antenna 2 with the longitudinal direction of the loop plane placed at an angle from the longitudinal direction of the loop plane of loop antenna 2. X, Y and Z represent their respective coordinate axes.

Tilted loop antenna 2 explained in the second embodiment is used as one transmission/reception antenna element that makes up the diversity antenna. Reception-only loop antenna 2' is used as the other antenna element. During transmission, only loop antenna 2 functions. During reception, loop antenna 2 and loop antenna 2' function and perform diversity operation.

In loop antenna 2, the longitudinal direction of the loop plane of the antenna is virtually perpendicular to the ground during communication, and thus its polarization plane matches vertical polarization of the base station. During communication transmission, it prevents a gain reduction due to a mismatch of the polarization plane. Since loop antenna 2 has directivity with less emission toward the human body, there is little influence of electromagnetic waves on the human body. During communication reception, it prevents a gain reduction due to a mismatch of the polarization plane, thus implementing a high-gain diversity antenna.

As shown above, the diversity antenna for portable radio apparatuses according to the eleventh embodiment of the present invention uses a tilted loop antenna as one transmission/reception antenna element that makes up the diversity antenna and a reception-only antenna as the other antenna element, thus preventing a gain reduction due to a mismatch of the polarization plane and implementing a high-gain diversity antenna, and at the same time decreasing emission toward the human body during transmission (communication), thus implementing an antenna with less influences of electromagnetic waves on the human body.

(Embodiment 12)

A twelfth embodiment of the present invention is a diversity antenna for portable radio apparatuses using a tilted loop antenna as one transmission/reception antenna element that makes up the diversity antenna and placing the other reception-only antenna element on the plane of the radio apparatus bottom board in the same direction as that of the human body.

Figure 23:
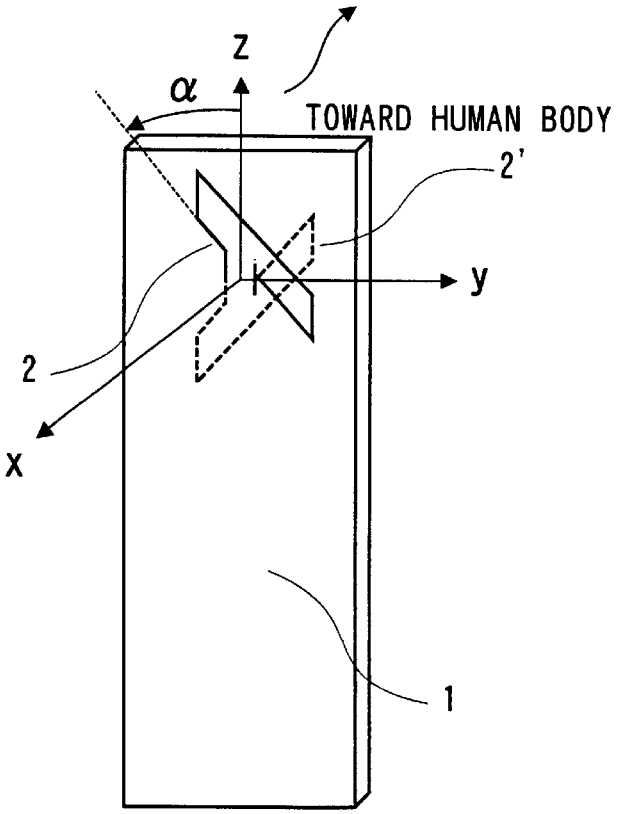
FIG. 23 illustrates a layout drawing of a built-in antenna for radio communication terminals according to Embodiment 12 of the present invention.

FIG. 23 is a layout drawing of the diversity antenna for portable radio apparatuses according to the twelfth embodiment of the present invention. In FIG. 23, 1 represents a radio apparatus bottom board and 2 represents one loop antenna that makes up the diversity antenna. Loop antenna 2 is a loop antenna with the longitudinal direction of the loop plane tilted approximately 60 degrees from the major axis direction of the radio apparatus bottom board (Z-axis direction). 2' represents a loop antenna similar to loop antenna 2 with the longitudinal direction of the loop plane placed at an angle from the longitudinal direction of the loop plane of loop antenna 2 on the plane of the radio apparatus bottom board in the direction of the human body. X, Y and Z represent their respective coordinate axes.

Tilted loop antenna 2 explained in the second embodiment is used as one transmission/reception antenna element that makes up the diversity antenna. Loop antenna 2' placed in the same direction as that of the human body is used as the other reception-only antenna element. During transmission, only loop antenna 2 functions. During reception, loop antenna 2 and loop antenna 2' function and perform diversity operation.

Since loop antenna 2 also has directivity toward the human body, it can implement diversity operation having directivity in all directions together with the operation of loop antenna 2 during reception such as a waiting time.

As shown above, since the diversity antenna for portable radio apparatuses according to the twelfth embodiment of the present invention uses a tilted loop antenna as one transmission/reception antenna element that makes up the diversity antenna and a loop antenna placed in the direction of the human body as the other reception-only antenna element, it can carry out diversity operation having directivity in all directions during reception such as a waiting time. Furthermore, this antenna prevents a gain reduction due to a mismatch of the polarization plane and reduces emission toward the human body during transmission (communication) and perform diversity operation with directivity in all directions.

(Embodiment 13)

A thirteenth embodiment of the present invention is a built-in antenna for radio communication terminals with a loop antenna element in the longitudinal direction of the loop plane bent.

Figure 24:
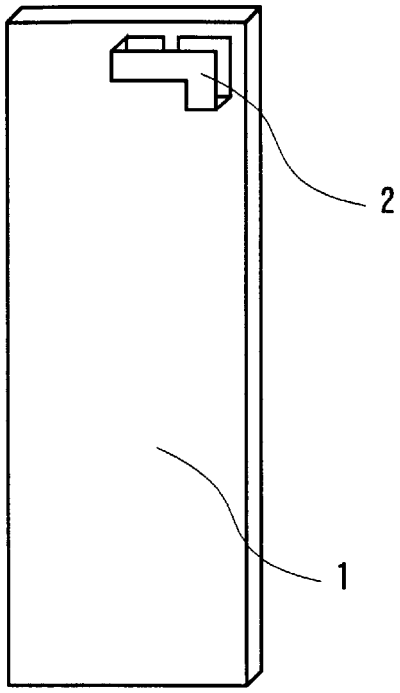
FIG. 24 illustrates a block diagram of a built-in antenna for radio communication terminals according to Embodiment 13 of the present invention.
Figure 25:
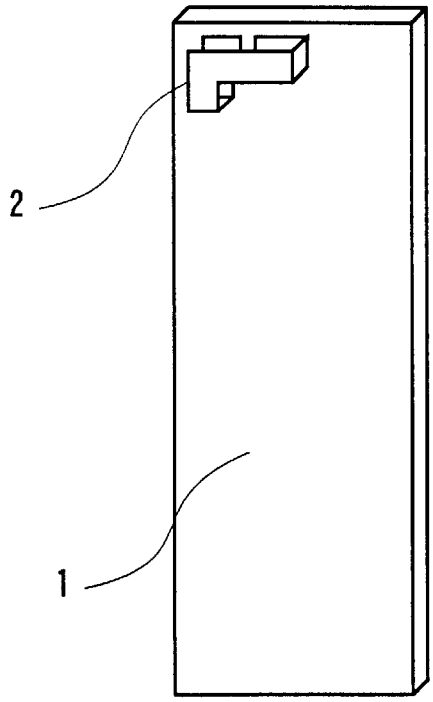
FIG. 25 illustrates a block diagram of the built-in antenna for radio communication terminals according to Embodiment 13 of the present invention.
Figure 26:
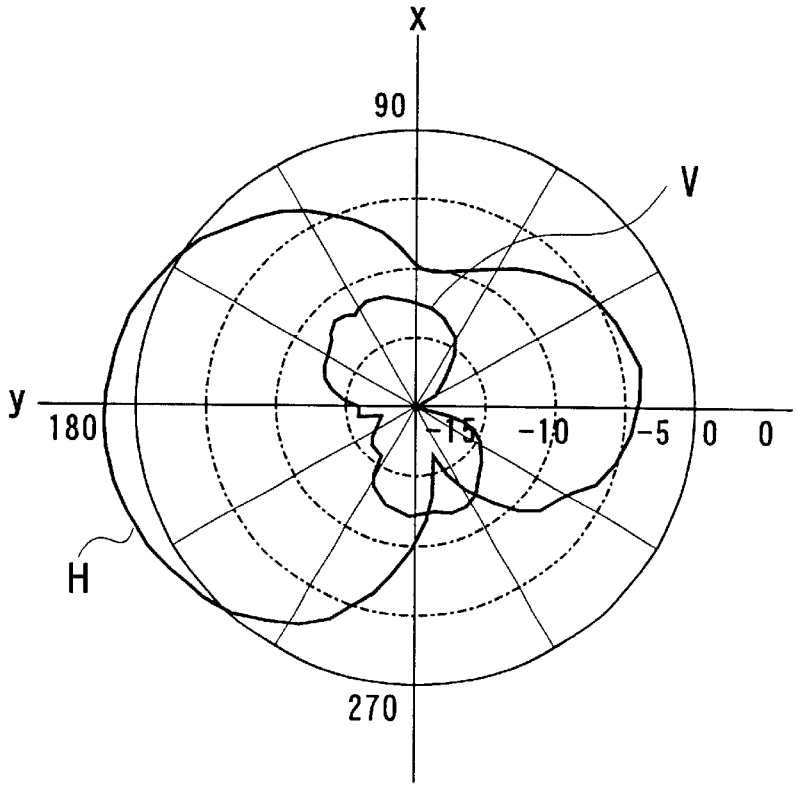
FIG. 26 illustrates the antenna directivity related to the built-in antenna for radio communication terminals according to Embodiment 13 of the present invention.
Figure 27:
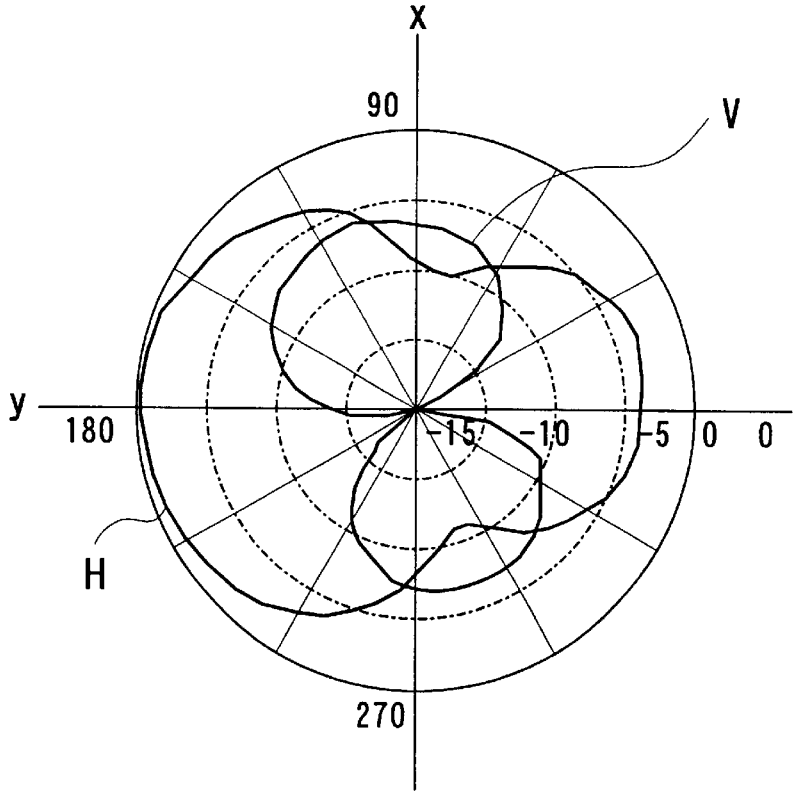
FIG. 27 illustrates the directivity of the built-in antenna for radio communication terminals according to Embodiment 13 of the present invention.

FIG. 24 and FIG. 25 are block diagrams of the built-in antenna for radio communication terminals according to the thirteenth embodiment of the present invention. In FIG. 24 and FIG. 25, 1 represents a radio apparatus bottom board and 2 represents a loop antenna element. FIG. 24 is an example of the loop antenna element placed to fit in the top right corner of the radio apparatus bottom board and FIG. 25 is an example of the loop antenna element placed to fit in the top left corner of the radio apparatus bottom board. Bending the loop antenna element allows the two polarized waves in bending direction to be transmitted/received. FIG. 26 and FIG. 27 show the directivity when each loop antenna element is bent and when not bent, respectively. In FIG. 26 and FIG. 27, H and V represent the horizontal polarization component and vertical polarization component, respectively. As seen from FIG. 27, bending the loop antenna element increases the vertical polarization component, making it possible to transmit/receive two polarized waves, vertical and horizontal.

As shown above, the built-in antenna for radio communication terminals according to the thirteenth embodiment of the present invention has a configuration with the loop plane longitudinal element of the loop antenna element bent, making it possible to transmit/receive two polarized waves in bending direction.

(Embodiment 14)

A fourteenth embodiment of the present invention is a built-in antenna for radio communication terminals with a bottom board fraction which is perpendicular to the plane of the radio apparatus bottom board provided at one end of the loop antenna element in the longitudinal direction of the loop plane at an extremely short distance compared with the wavelength.

Figure 28:
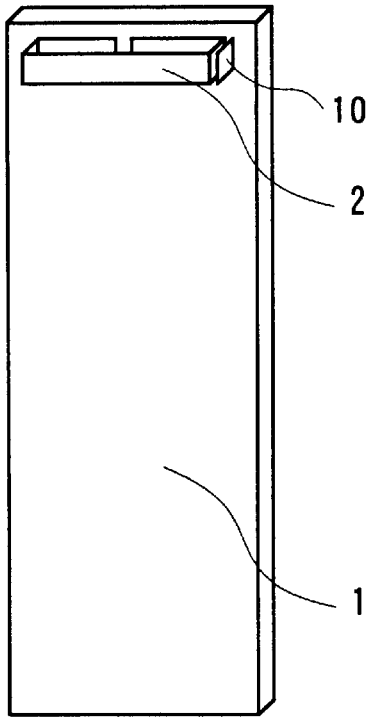
FIG. 28 illustrates a block diagram of a built-in antenna for radio communication terminals according to embodiment 14 of the present invention.
Figure 29:
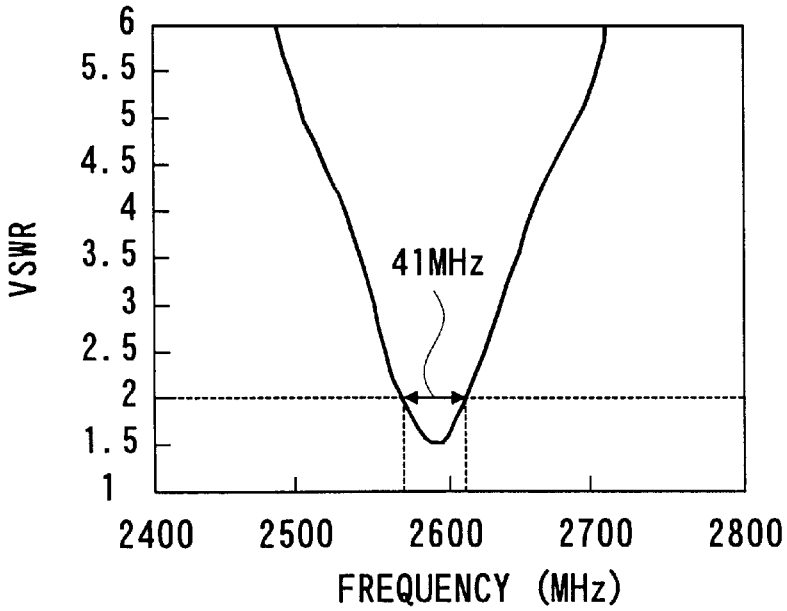
FIG. 29 illustrates an antenna impedance characteristic diagram related to the built-in antenna for radio communication terminals according to Embodiment 14 of the present invention.
Figure 30:
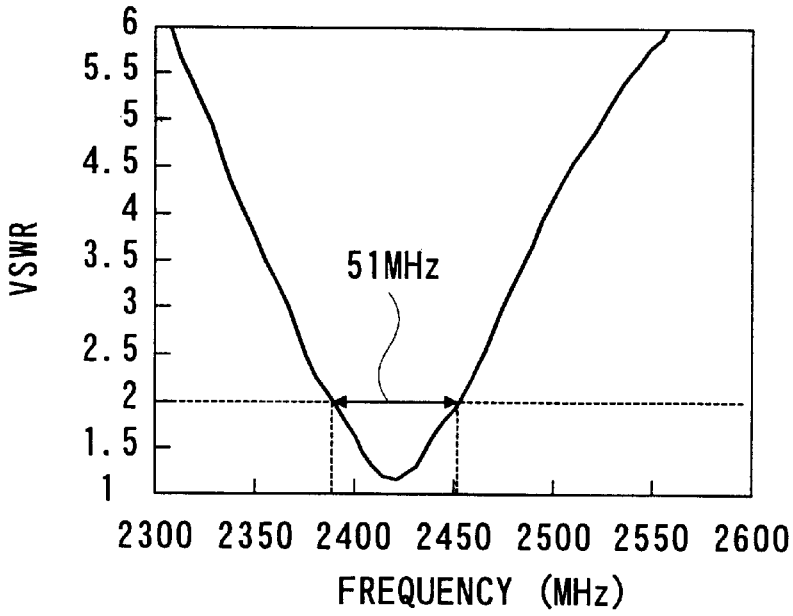
FIG. 30 illustrates an antenna impedance characteristic diagram of the built-in antenna for radio communication terminals according to Embodiment 14 of the present invention.

FIG. 28 is a block diagram of the built-in antenna for radio communication terminals according to the fourteenth embodiment of the present invention. In FIG. 28, 1 represents a radio apparatus bottom board; 2, a loop antenna element; 10, a bottom board fraction. Providing a bottom board fraction at one end of the loop antenna element in the longitudinal direction of the loop plane allows the antenna resonance frequency to be reduced, equivalently reducing the size of the antenna and implementing a wideband antenna. FIG. 29 and FIG. 30 show the impedance characteristics without the bottom board fraction and with the bottom board fraction provided at one end of the element in the longitudinal direction of the loop plane when the loop length is 31 mm in both cases. In FIG. 29, the antenna resonance frequency is 2.59 GHz, the bandwidth is 41 MHz and the specific bandwidth is 15%. In FIG. 30, the antenna resonance frequency is 2.42 GHz, the bandwidth is 51 MHz and the specific bandwidth is 17%. In FIG. 29 and FIG. 30, the resonance frequency is reduced from 2.59 GHz to 2.42 GHz with and without the bottom board fraction, showing that providing the bottom board fraction makes it possible to equivalently reduce the size of the antenna. At the same time the specific bandwidth increases from 15% to 17%, making it possible to equivalently implement a wideband antenna.

As shown above, the built-in antenna for radio communication terminals according to the fourteenth embodiment of the present invention has the configuration with a bottom board fraction which is set perpendicular to the plane of the radio apparatus bottom board provided at one end of the loop antenna element in the longitudinal direction of the loop plane at an extremely short distance compared with the wavelength, which makes it possible not only to reduce the size of the antenna but also to implement a wideband antenna.

(Embodiment 15)

A fifteenth embodiment of the present invention is a built-in antenna for radio communication terminals with bottom board fractions which are set perpendicular to the plane of the radio apparatus bottom board provided at both ends of the loop antenna element in the longitudinal direction of the loop plane at an extremely short distance compared with the wavelength.

Figure 31:
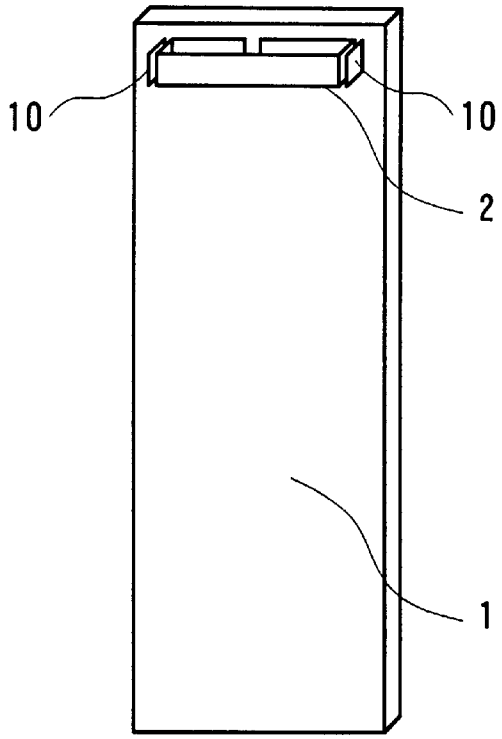
FIG. 31 illustrates a block diagram of a built-in antenna for radio communication terminals according to Embodiment 15 of the present invention.
Figure 32:
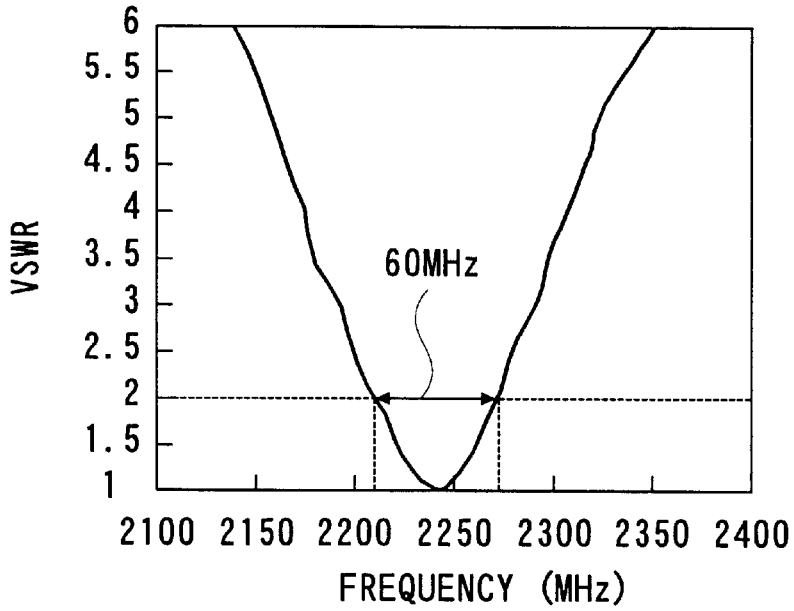
FIG. 32 illustrates an impedance characteristic diagram of the built-in antenna for radio communication terminals according to Embodiment 15 of the present invention.

FIG. 31 is a block diagram of the built-in antenna for radio communication terminals according to the fifteenth embodiment of the present invention. In FIG. 31, 1 represents a radio apparatus bottom board; 2, a loop antenna element; 10, a bottom board fraction. Providing bottom board fractions at both ends of the loop antenna element in the longitudinal direction of the loop plane allows the antenna resonance frequency to be reduced more than the fourteenth embodiment, equivalently reducing the size of the antenna and implementing a wideband antenna. FIG. 32 shows the impedance characteristic with the bottom board fractions provided at both ends in the longitudinal direction of the loop plane when the loop length is 31 mm. In FIG. 32, the antenna resonance frequency is 2.24 GHz, the bandwidth is 60 MHz and the specific bandwidth is 24%.

When compared with the loop antenna in the fourteenth embodiment, its resonance frequency is reduced from 2.42 GHz to 2.24 GHz and provision of the bottom boards at both ends in the longitudinal direction of the loop plane further equivalently reduces the size of the antenna. At the same time, the specific bandwidth increases from 17% to 24%, further widening the band of the antenna.

As shown above, the built-in antenna for radio communication terminals according to the fifteenth embodiment of the present invention has the configuration with bottom board fractions which are set perpendicular to the plane of the radio apparatus bottom board provided at both ends of the loop antenna element in the longitudinal direction of the loop plane at an extremely short distance compared with the wavelength, which not only reduces the size of the antenna but also achieves a wideband antenna.

(Embodiment 16)

A sixteenth embodiment of the present invention is a built-in antenna for radio communication terminals with a bottom board fraction which is set perpendicular to the plane of the radio apparatus bottom board provided at one end of the loop antenna element whose loop plane in the longitudinal direction is bent.

Figure 33:
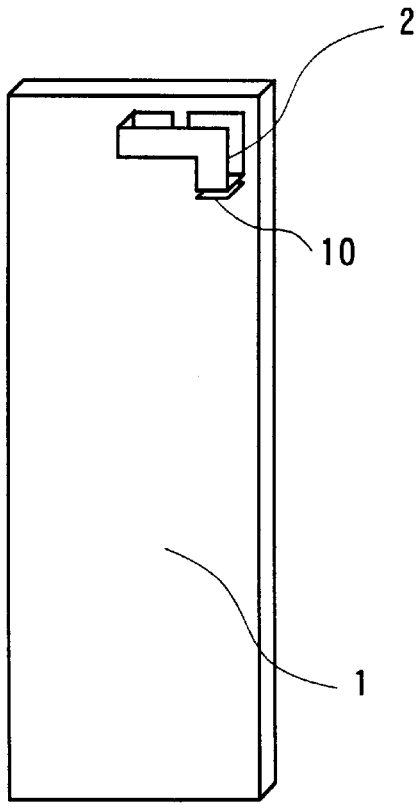
FIG. 33 illustrates a block diagram of a built-in antenna for radio communication terminals according to Embodiment 16 of the present invention.
Figure 34:
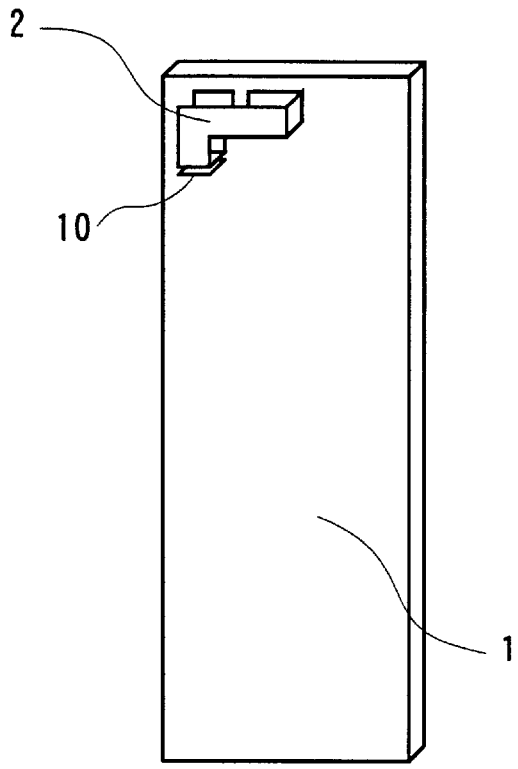
FIG. 34 illustrates a block diagram of the built-in antenna for radio communication terminals according to Embodiment 16 of the present invention.

FIG. 33 and FIG. 34 are block diagrams of the built-in antenna for radio communication terminals according to the sixteenth embodiment of the present invention. FIG. 33 shows a case where the loop antenna element is bent to fit in the top right corner of the radio apparatus bottom board and FIG. 34 shows a case where it is bent to fit in the top left corner. In FIG. 33 and FIG. 34, 1 represents a radio apparatus bottom board; 2, a loop antenna element; 10, a bottom board fraction.

Providing a bottom board fraction at one end of the loop antenna element whose loop plane in the longitudinal direction is bent not only allows polarized waves to be transmitted/received as in the case of the thirteenth embodiment but also makes it possible to reduce the resonance frequency of the antenna, thus equivalently reducing the size of the antenna and implementing a wideband antenna.

As shown above, the built-in antenna for radio communication terminals according to the sixteenth embodiment of the present invention has a configuration with a bottom board fraction provided at one end of the loop antenna element whose loop plane in the longitudinal direction is bent, which makes it possible not only to transmit/receive two polarized waves but also to reduce the resonance frequency of the antenna, thus equivalently reducing the size of the antenna and implementing a wideband antenna.

(Embodiment 17)

A seventeenth embodiment of the present invention is a built-in antenna for radio communication terminals with bottom board fractions which are set perpendicular to the plane of the radio apparatus bottom board provided at both ends of the loop antenna element whose loop plane in the longitudinal direction is bent at an extremely short distance compared with the wavelength from the plane of the radio apparatus bottom board.

Figure 35:
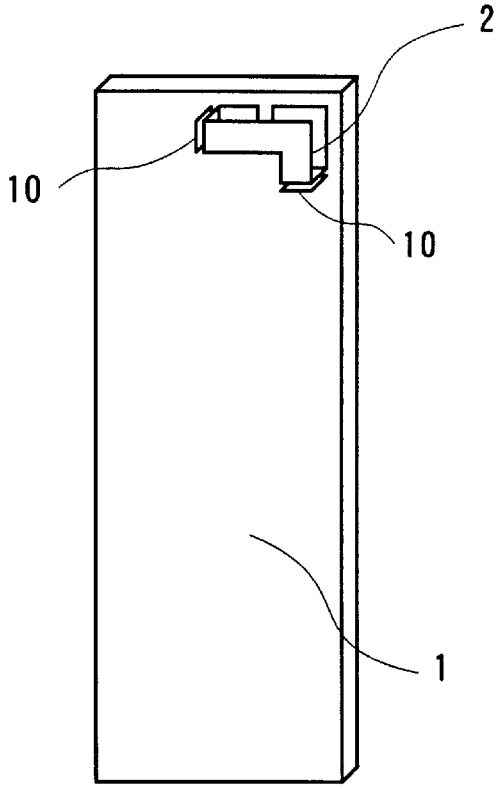
FIG. 35 illustrates a block diagram of the built-in. antenna for radio communication terminals according to Embodiment 16 of the present invention.
Figure 36:
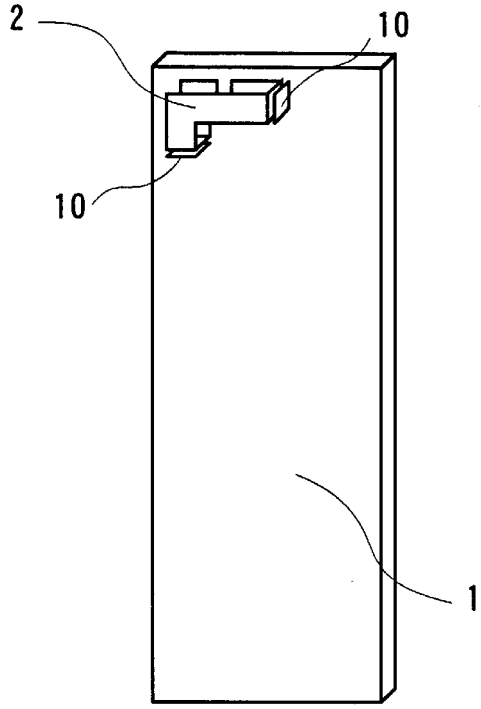
FIG. 36 illustrates a block diagram of a built-in antenna for radio communication terminals according to Embodiment 17 of the present invention.

FIG. 35 and FIG. 36 are block diagrams of the built-in antenna for radio communication terminals according to the seventeenth embodiment of the present invention. FIG. 35 shows a case where the loop antenna element is bent to fit in the top right corner of the radio apparatus bottom board and FIG. 36 shows a case where it is bent to fit in the top left corner. In FIG. 35 and FIG. 36, 1 represents a radio apparatus bottom board; 2, a loop antenna element; 10, a bottom board fraction. Providing bottom board fractions at both ends of the loop antenna element whose loop plane in the longitudinal direction is bent not only allows two polarized waves to be transmitted/received as in the case of the thirteenth embodiment but also makes it possible to reduce the resonance frequency of the antenna more than the sixteenth embodiment, thus equivalently reducing the size of the antenna and implementing a wideband antenna.

As shown above, the built-in antenna for radio communication terminals according to the seventeenth embodiment of the present invention has a configuration with bottom board fractions provided at both ends of the loop antenna element whose loop plane in the longitudinal direction is bent, which makes it possible not only to transmit/receive polarized waves in the two bending directions but also to reduce the resonance frequency of the antenna more than the sixteenth embodiment, thus equivalently reducing the size of the antenna and implementing a wideband antenna.

(Embodiment 18)

An eighteenth embodiment of the present invention is a diversity antenna for portable radio apparatuses using the loop antenna of the thirteenth embodiment as one reception-only antenna that makes up the diversity antenna and a mono-pole antenna used for reception and transmission as the other antenna element.

Figure 37:
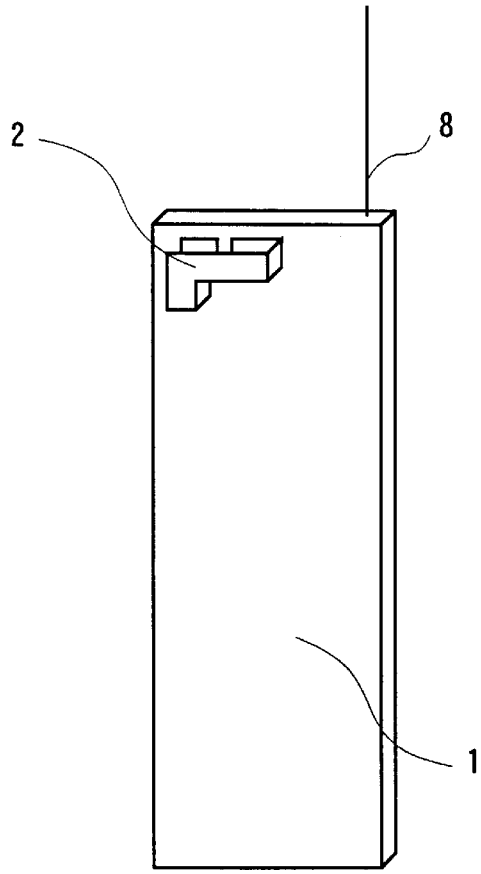
FIG. 37 illustrates a block diagram of a diversity antenna for portable radio apparatuses according to Embodiment 18 of the present invention.

FIG. 37 is a block diagram of the diversity antenna for portable radio apparatuses according to the eighteenth embodiment of the present invention. In FIG. 37, 1 represents a radio apparatus bottom board and 2 represents the loop antenna element of the thirteenth embodiment which is the reception-only antenna that makes up the diversity antenna. 8 represents a mono-pole antenna which is the other antenna element that makes up the diversity antenna. For one antenna element that makes up the diversity antenna for only reception use, loop antenna 2 described in the thirteenth embodiment is used. For the other antenna element, mono-pole antenna 8 for both transmission and reception is used. During transmission, only mono-pole antenna 8 functions. During reception, mono-pole antenna 8 and loop antenna 2 function and perform diversity operation. The loop antenna of the thirteenth embodiment can receive two polarized waves in the bending direction of the antenna element.

As shown above, the diversity antenna for portable radio apparatuses according to the eighteenth embodiment of the present invention uses the loop antenna of the thirteenth embodiment as one reception-only antenna which makes up the diversity antenna and the mono-pole antenna used for reception and transmission as the other antenna element, thus making it possible to receive two polarized waves during diversity operation.

(Embodiment 19)

A nineteenth embodiment of the present invention is a diversity antenna for portable radio apparatuses using the loop antenna of the fourteenth embodiment as one reception-only antenna that makes up the diversity antenna, and a mono-pole antenna used for reception and transmission as the other antenna element.

Figure 38:
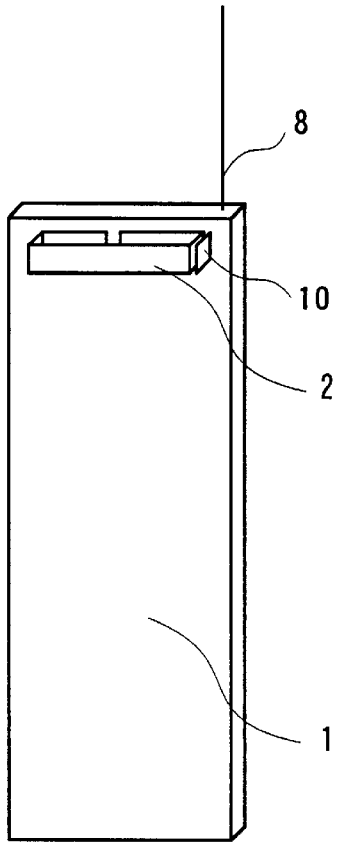
FIG. 38 illustrates a block diagram of a diversity antenna for portable radio apparatuses according to Embodiment 19 of the present invention.

FIG. 38 is a block diagram of the diversity antenna for portable radio apparatuses according to the nineteenth embodiment of the present invention. In FIG. 38, 1 represents a radio apparatus bottom board and 2 and 10 represent the loop antenna of the fourteenth embodiment which is the one reception-only antenna that makes up the diversity antenna. 8 represents a mono-pole antenna which is the other antenna element that makes up the diversity antenna. For the one reception-only antenna element that makes up the diversity antenna, loop antenna 2 of the fourteenth embodiment with bottom board fraction 10 is used. For the other antenna element, mono-pole antenna 8 for both transmission and reception is used. During transmission, only mono-pole antenna 8 functions. During reception, mono-pole antenna 8 and loop antenna 2 with bottom board fraction 10 function and perform diversity operation. The loop antenna of the fourteenth embodiment is a small, wideband antenna.

As shown above, the diversity antenna for portable radio apparatuses according to the nineteenth embodiment of the present invention uses the loop antenna of the fourteenth embodiment as one reception-only antenna which makes up the diversity antenna and the mono-pole antenna used for reception and transmission as the other antenna element, thus implementing a small, wideband diversity antenna.

(Embodiment 20)

A twentieth embodiment of the present invention is a diversity antenna for portable radio apparatuses using the loop antenna of the fifteenth embodiment as one reception-only antenna that makes up the diversity antenna, and a mono-pole antenna used for reception and transmission as the other antenna element.

Figure 39:
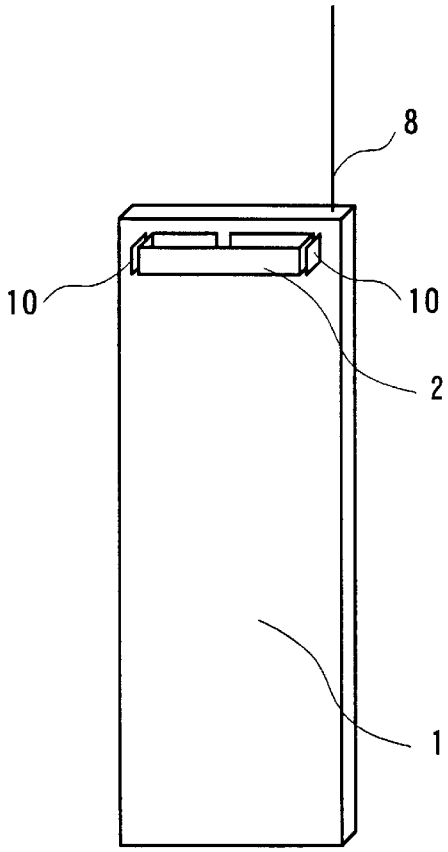
FIG. 39 illustrates a block diagram of a diversity antenna for portable radio apparatuses according to Embodiment 20 of the present invention.

FIG. 39 is a block diagram of the diversity antenna for portable radio apparatuses according to the twentieth embodiment of the present invention. In FIG. 39, 1 represents a radio apparatus bottom board and 2 and 10 represent the loop antenna of the fifteenth embodiment which is the one reception-only antenna that makes up the diversity antenna. 8 represents a mono-pole antenna which is the other antenna element that makes up the diversity antenna. For the one reception-only antenna element that makes up the diversity antenna, loop antenna 2 of the fifteenth embodiment with bottom board fraction 10 is used. For the other antenna element, mono-pole antenna 8 for both transmission and reception is used. During transmission, only mono-pole antenna 8 functions. During reception, mono-pole antenna 8 and loop antenna 2 with bottom board fraction 10 function and perform diversity operation. The loop antenna of the fifteenth embodiment is an antenna smaller, with wider band than that of the fourteenth embodiment.

As shown above, the diversity antenna for portable radio apparatuses according to the twentieth embodiment of the present invention uses the loop antenna of the fifteenth embodiment as one reception-only antenna that makes up the diversity antenna and the mono-pole antenna used for reception and transmission as the other antenna element, thus implementing a small, wider band diversity antenna.

(Embodiment 21)

A twenty-first embodiment of the present invention is a diversity antenna for portable radio apparatuses using the loop antenna of the sixteenth embodiment as one reception-only antenna that makes up the diversity antenna, and a mono-pole antenna used for reception and transmission as the other antenna element.

Figure 40:
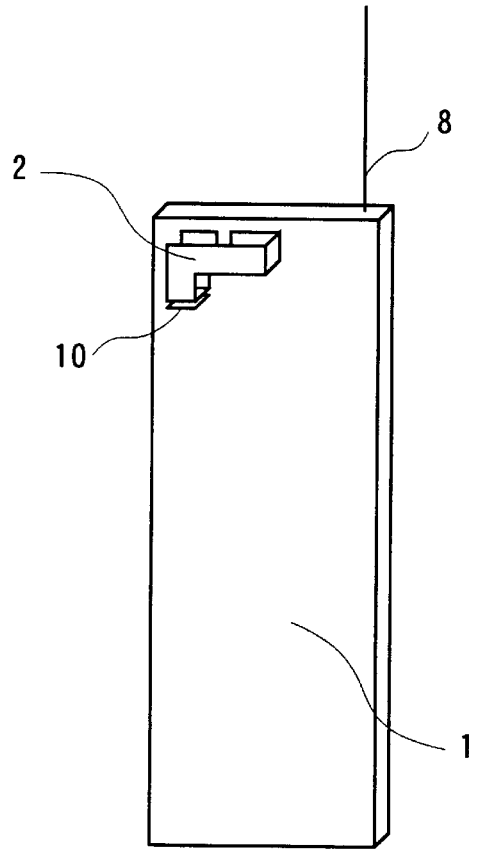
FIG. 40 illustrates a block diagram of a diversity antenna for portable radio apparatuses according to Embodiment 21 of the present invention.

FIG. 40 is a block diagram of the diversity antenna for portable radio apparatuses according to the twenty-first embodiment of the present invention. In FIG. 40, 1 represents a radio apparatus bottom board and 2 and 10 represent the loop antenna of the sixteenth embodiment which is the one reception-only antenna that makes up the diversity antenna. 8 represents a mono-pole antenna which is the other antenna element that makes up the diversity antenna. For the one reception-only antenna element that makes up the diversity antenna, loop antenna 2 of the sixteenth embodiment with bottom board fraction 10 is used. For the other antenna element, mono-pole antenna 8 for both transmission and reception is used. During transmission, only mono-pole antenna 8 functions. During reception, mono-pole antenna 8 and loop antenna 2 with bottom board fraction 10 function and perform diversity operation. The loop antenna of the sixteenth embodiment is a small, wideband antenna capable of receiving two polarized waves.

As shown above, the diversity antenna for portable radio apparatuses according to the twenty-first embodiment of the present invention uses the loop antenna of the sixteenth embodiment as one reception-only antenna that makes up the diversity antenna and the mono-pole antenna used for reception and transmission as the other antenna element, thus implementing a small, wideband diversity antenna capable of receiving two polarized waves.

(Embodiment 22)

A twenty-second embodiment of the present invention is a diversity antenna for portable radio apparatuses using the loop antenna of the seventeenth embodiment as one reception-only antenna that makes up the diversity antenna, and a mono-pole antenna used for reception and transmission as the other antenna element.

Figure 41:
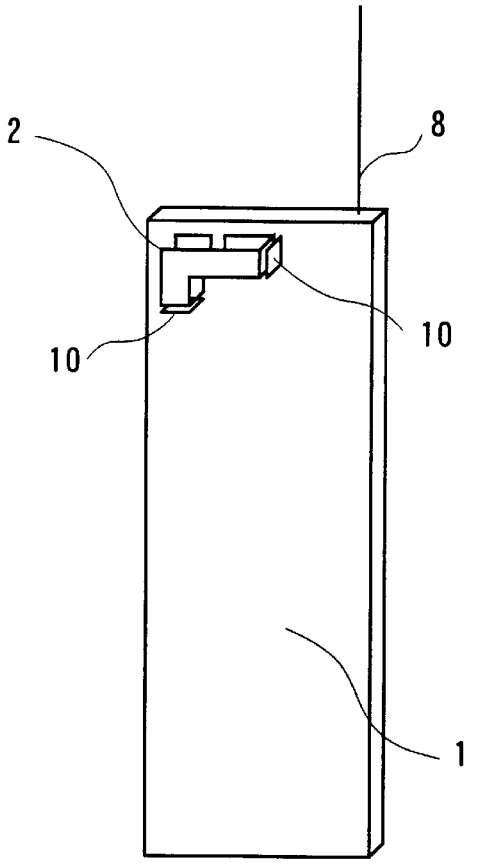
FIG. 41 illustrates a block diagram of a diversity antenna for portable radio apparatuses according to Embodiment 22 of the present invention.

FIG. 41 is a block diagram of the diversity antenna for portable radio apparatuses according to the twenty-second embodiment of the present invention. In FIG. 41, 1 represents a radio apparatus bottom board and 2 and 10 represent the loop antenna of the seventeenth embodiment which is the one reception-only antenna that makes up the diversity antenna. 8 represents a mono-pole antenna which is the other antenna element that makes up the diversity antenna. For the one reception-only antenna element that makes up the diversity antenna, loop antenna 2 of the seventeenth embodiment with bottom board fraction 10 is used. For the other antenna element, mono-pole antenna 8 for both transmission and reception is used. During transmission, only mono-pole antenna 8 functions. During reception, mono-pole antenna 8 and loop antenna 2 with bottom board fraction 10 function and perform diversity operation. The loop antenna of the seventeenth embodiment is an antenna smaller, with wider band than that of the sixteenth embodiment.

As shown above, the diversity antenna for portable radio apparatuses according to the twenty-second embodiment of the present invention uses the loop antenna of the seventeenth embodiment as one reception-only antenna that makes up the diversity antenna and the mono-pole antenna used for reception and transmission as the other antenna element, thus implementing a small, wideband diversity antenna capable of receiving two polarized waves as a diversity reception-only antenna.

(Embodiment 23)

A twenty-third embodiment of the present invention is a diversity antenna for portable radio apparatuses using the loop antenna of the thirteenth embodiment as one reception-only antenna that makes up the diversity antenna, and the tabular loop antenna of the seventh embodiment used for reception and transmission as the other antenna element.

Figure 42:
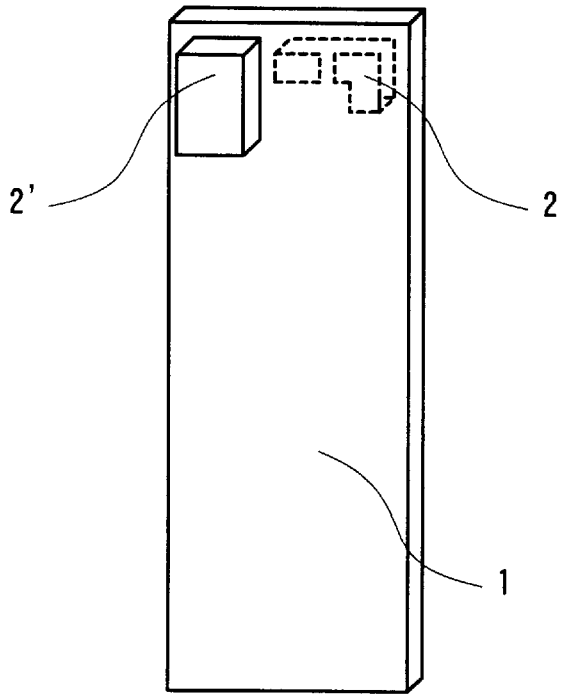
FIG. 42 illustrates a block diagram of a diversity antenna for portable radio apparatuses according to Embodiment 23 of the present invention.

FIG. 42 is a block diagram of the diversity antenna for portable radio apparatuses according to the twenty-third embodiment of the present invention. In FIG. 42, 1 represents a radio apparatus bottom board and 2 represents the loop antenna of the thirteenth embodiment which is the one reception-only antenna that makes up the diversity antenna. 2' represents the other antenna element that makes up the diversity antenna which is the tabular loop antenna of the seventh embodiment placed on the plane of the bottom board opposite to the human body. For the one reception-only antenna element that makes up the diversity antenna, loop antenna 2 of the thirteenth embodiment is used. For the other antenna element, loop antenna 2' described in the seventh embodiment is used for both transmission and reception. During transmission, only tabular loop antenna 2' functions. During reception, tabular loop antenna 2' and loop antenna 2 function and perform diversity operation. The loop antenna of the seventh embodiment has a wideband characteristic and the loop antenna of the thirteenth embodiment is capable of receiving two polarized waves in the bending direction of the antenna element.

As shown above, the diversity antenna for portable radio apparatuses according to the twenty-third embodiment of the present invention uses the loop antenna of the thirteenth embodiment as one reception-only antenna that makes up the diversity antenna and the tabular loop antenna of the seventh embodiment used for reception and transmission as the other antenna element, thus implementing a small, wideband diversity antenna capable of receiving two polarized waves.

(Embodiment 24)

A twenty-fourth embodiment of the present invention is a diversity antenna for portable radio apparatuses using the loop antenna of the fourteenth embodiment as one reception-only antenna that makes up the diversity antenna, and the tabular loop antenna of the seventh embodiment used for reception and transmission as the other antenna element.

Figure 43:
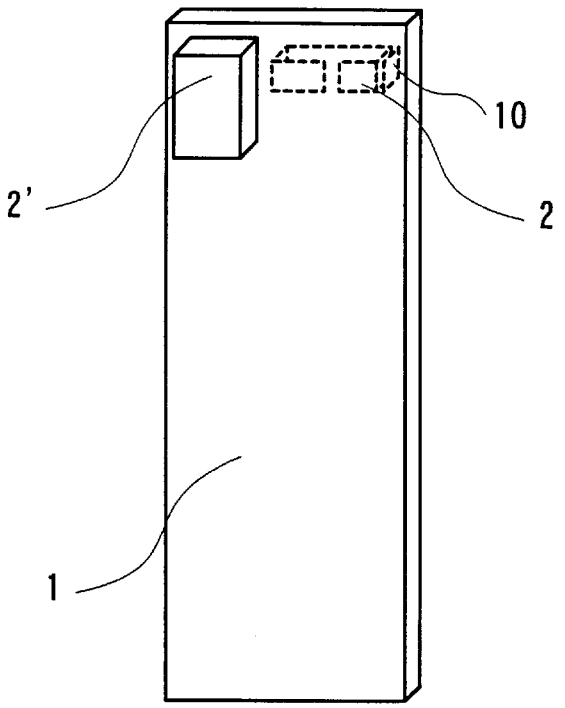
FIG. 43 illustrates a block diagram of a diversity antenna for portable radio apparatuses according to Embodiment 24 of the present invention.

FIG. 43 is a block diagram of the diversity antenna for portable radio apparatuses according to the twenty-fourth embodiment of the present invention. In FIG. 43, 1 represents a radio apparatus bottom board and 2 represents the loop antenna of the fourteenth embodiment which is the one reception-only antenna that makes up the diversity antenna. 2' represents the other antenna element that makes up the diversity antenna which is the tabular loop antenna of the seventh embodiment placed on the plane of the bottom board opposite to the human body. For the one reception-only antenna element that makes up the diversity antenna, loop antenna 2 of the fourteenth embodiment is used. For the other antenna element, loop antenna 2' of the seventh embodiment is used for both transmission and reception. During transmission, only tabular loop antenna 2' functions. During reception, tabular loop antenna 2' and loop antenna 2 function and perform diversity operation. The loop antenna of the seventh embodiment has a wideband characteristic and the loop antenna of the fourteenth embodiment is a small, wideband antenna.

As shown above, the diversity antenna for portable radio apparatuses according to the twenty-fourth embodiment of the present invention uses the loop antenna of the fourteenth embodiment as one reception-only antenna that makes up the diversity antenna and the tabular loop antenna of the seventh embodiment used for reception and transmission as the other antenna element, thus implementing a small, wideband diversity antenna.

(Embodiment 25)

A twenty-fifth embodiment of the present invention is a diversity antenna for portable radio apparatuses using the loop antenna of the fifteenth embodiment as one reception-only antenna that makes up the diversity antenna, and the tabular loop antenna of the seventh embodiment used for reception and transmission as the other antenna element.

Figure 44:
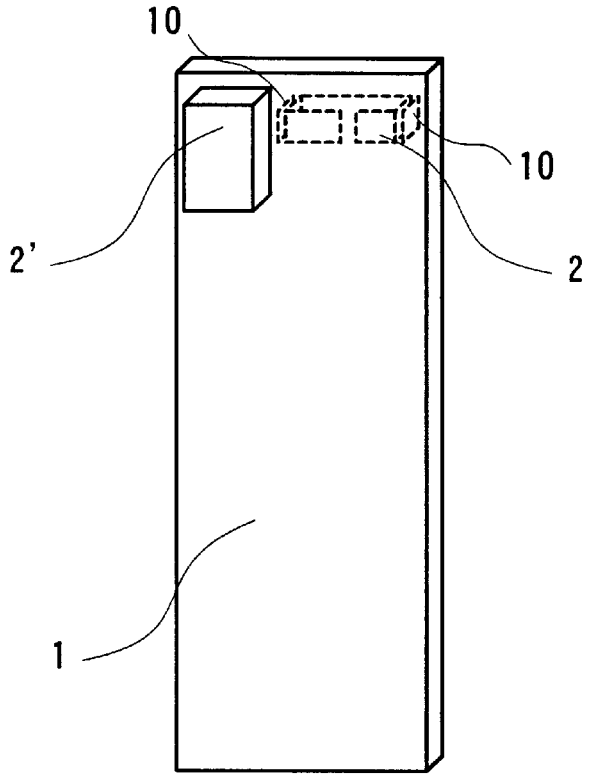
FIG. 44 illustrates a block diagram of a diversity antenna for portable radio apparatuses according to Embodiment 25 of the present invention.

FIG. 44 is a block diagram of the diversity antenna for portable radio apparatuses according to the twenty-fifth embodiment of the present invention. In FIG. 44, 1 represents a radio apparatus bottom board and 2 represents the loop antenna of the fifteenth embodiment which is the one reception-only antenna that makes up the diversity antenna. 2' represents the other antenna element that makes up the diversity antenna which is the tabular loop antenna of the seventh embodiment placed on the plane of the bottom board opposite to the human body. For the one reception-only antenna element that makes up the diversity antenna, loop antenna 2 of the fifteenth embodiment is used. For the other antenna element, loop antenna 2' of the seventh embodiment is used for both transmission and reception. During transmission, only tabular loop antenna 2' functions. During reception, tabular loop antenna 2' and loop antenna 2 function and perform diversity operation. The loop antenna of the seventh embodiment has a wideband characteristic and the loop antenna of the fifteenth embodiment is an antenna smaller, with wider band than that of the fourteenth embodiment.

As shown above, the diversity antenna for portable radio apparatuses according to the twenty-fifth embodiment of the present invention uses the loop antenna of the fifteenth embodiment as one reception-only antenna which makes up the diversity antenna and the tabular loop antenna of the seventh embodiment used for reception and transmission as the other antenna element, thus implementing a small, wideband diversity antenna.

(Embodiment 26)

A twenty-sixth embodiment of the present invention is a diversity antenna for portable radio apparatuses using the loop antenna of the sixteenth embodiment as one reception-only antenna that makes up the diversity antenna, and the tabular loop antenna of the seventh embodiment used for reception and transmission as the other antenna element.

Figure 45:
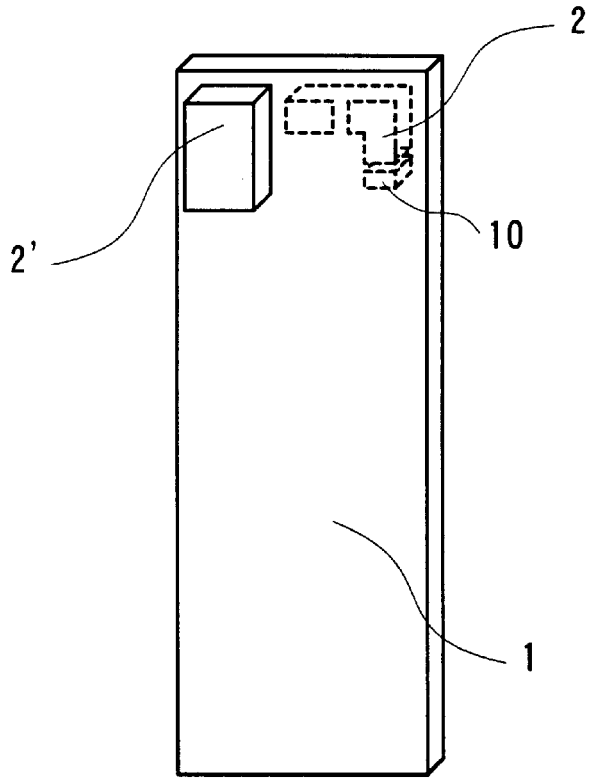
FIG. 45 illustrates a block diagram of a diversity antenna for portable radio apparatuses according to Embodiment 26 of the present invention.

FIG. 45 is a block diagram of the diversity antenna for portable radio apparatuses according to the twenty-sixth embodiment of the present invention. In FIG. 45, 1 represents a radio apparatus bottom board and 2 represents the loop antenna of the sixteenth embodiment which is the one reception-only antenna that makes up the diversity antenna. 2' represents the other antenna element that makes up the diversity antenna which is the tabular loop antenna of the seventh embodiment placed on the plane of the bottom board opposite to the human body. For the one reception-only antenna element that makes up the diversity antenna, loop antenna 2 of the sixteenth embodiment is used. For the other antenna element, loop antenna 2' of the seventh embodiment is used for both transmission and reception. During transmission, only tabular loop antenna 2' functions. During reception, tabular loop antenna 2' and loop antenna 2 function and perform diversity operation. The loop antenna of the seventh embodiment has a wideband characteristic and the loop antenna of the sixteenth embodiment is a small, wideband antenna capable of receiving two polarized waves.

As shown above, the diversity antenna for portable radio apparatuses according to the twenty-sixth embodiment of the present invention uses the loop antenna of the sixteenth embodiment as one reception-only antenna that makes up the diversity antenna and the tabular loop antenna of the seventh embodiment used for reception and transmission as the other antenna element, thus implementing a small, wideband diversity antenna capable of receiving two polarized waves.

(Embodiment 27)

A twenty-seventh embodiment of the present invention is a diversity antenna for portable radio apparatuses using the loop antenna of the seventeenth embodiment as one reception-only antenna that makes up the diversity antenna, and the tabular loop antenna of the seventh embodiment used for reception and transmission as the other antenna element.

Figure 46:
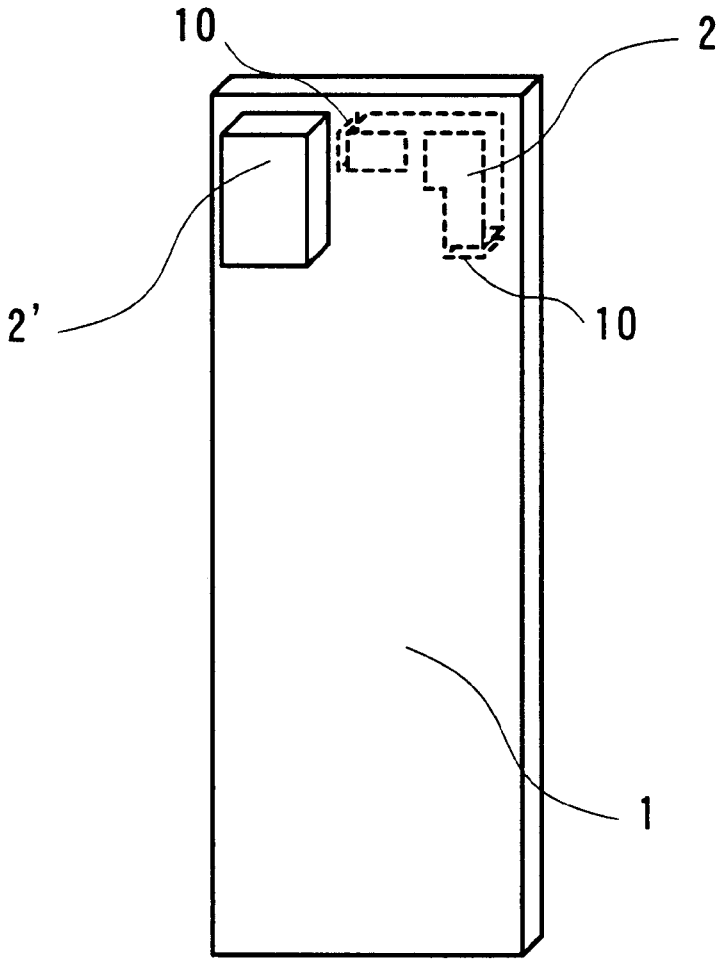
FIG. 46 illustrates a block diagram of a diversity antenna for portable radio apparatuses according to Embodiment 27 of the present invention.

FIG. 46 is a block diagram of the diversity antenna for portable radio apparatuses according to the twenty-seventh embodiment of the present invention. In FIG. 46, 1 represents a radio apparatus bottom board and 2 represents the loop antenna of the seventeenth embodiment which is the one reception-only antenna that makes up the diversity antenna. 2' represents the other antenna element that makes up the diversity antenna which is the tabular loop antenna of the seventh embodiment placed on the plane of the bottom board opposite to the human body. For the one reception-only antenna element that makes up the diversity antenna, loop antenna 2 of the seventeenth embodiment is used. For the other antenna element, loop antenna 2' of the seventh embodiment is used for both transmission and reception. During transmission, only tabular loop antenna 2' functions. During reception, tabular loop antenna 2' and loop antenna 2 function and perform diversity operation. The loop antenna of the seventh embodiment has a wideband characteristic and the loop antenna of the seventeenth embodiment is an antenna smaller, with wider band than that of the sixteenth embodiment capable of receiving two polarized waves.

As shown above, the diversity antenna for portable radio apparatuses according to the twenty-seventh embodiment of the present invention uses the loop antenna of the seventeenth embodiment as one reception-only antenna that makes up the diversity antenna and the tabular loop antenna of the seventh embodiment used for reception and transmission as the other antenna element, thus implementing an antenna smaller, with wider band than that of the sixteenth embodiment capable of receiving two polarized waves.

As shown above, the built-in antenna for radio communication terminals according to the present invention has the loop antenna placed on the plane of the radio apparatus bottom board opposite to the human body during communication, which provides the effect of making it possible not only to implement a high-gain antenna with directivity in direction opposite to the human body but also to reduce emission of electromagnetic waves toward the human body during transmission.

Furthermore, the built-in antenna for radio communication terminals according to the present invention places the loop antenna in such a way that allows vertically polarized waves to be transmitted/received during communication, providing the effect of preventing a gain reduction due to a mismatch of the polarization plane with that of the base station, and implementing a high-gain antenna.

The diversity antenna for radio communication terminals according to the present invention uses the loop antenna having directivity opposite to the human body as one reception-only antenna element, providing the effect of implementing a high-gain diversity antenna with less influences of the human body during communication.

This application is based on the Japanese Patent Application No.HEI 10-32401 filed on Jan. 30, 1998, entire content of which is expressly incorporated by reference herein.

What is claimed is:

1. A built-in antenna for a radio communication terminal, comprising:

a terminal bottom board, comprising a grounded conductor;

a helical di-pole antenna, connecting to said terminal bottom board and being positioned so that a plane of said helical di-pole antenna is perpendicular to a plane of said terminal bottom board, said helical dipole antenna having a diameter not exceeding 0.1 wavelength; and a balanced/unbalanced conversion circuit, comprising an impedance conversion system and connecting to a feeding end of said helical di-pole antenna;

wherein said terminal bottom board reflects an electromagnetic wave from said helical di-pole antenna in a direction away from a user; and wherein said balanced/unbalanced conversion circuit minimizes an antenna current flowing to said terminal bottom board.

2. A built-in antenna for a radio communication terminal, comprising:

a terminal bottom board, comprising a grounded conductor;

a loop antenna, connecting to said terminal bottom board and being positioned so that a loop plane of said loop antenna is perpendicular to a plane of said terminal bottom board; and a balanced/unbalanced conversion circuit, comprising an impedance conversion system and connecting to a feeding end of said loop antenna;

wherein said terminal bottom board reflects an electromagnetic wave from said loop antenna in a direction away from a user; and wherein said balanced/unbalanced conversion circuit minimizes an antenna current flowing to said terminal bottom board.

3. The built-in antenna for a radio communication terminal according to claim 2, further comprising a reactance element positioned at a midpoint of said loop antenna.

4. The built-in antenna for a radio communication terminal according to claim 2, further comprising a variable capacitative element connected to the feeding end of said loop antenna.

5. The built-in antenna for a radio communication terminal according to claim 2, further comprising at least one circuit at the feeding end of said loop antenna, the at least one circuit comprising a plurality of tuning elements and a plurality of switching elements, wherein the built-in antenna switches frequency bands by switching the plurality of switching elements to perform tuning for each of the frequency bands.

6. The built-in antenna for a radio communication terminal according to claim 2, said loop antenna comprising a zig zag configuration.

7. The built-in antenna for a radio communication terminal according to claim 2, said loop antenna comprising a tabular configuration.

8. The built-in antenna according to claim 2, in combination with a mono-pole antenna, the built-in antenna comprising a reception-only antenna element of a diversity antenna and the mono-pole antenna comprising a reception and transmission antenna element of the diversity antenna.

9. The built-in antenna for a radio communication terminal according to claim 2, said loop antenna having a loop plane longitudinal element; and said terminal bottom board further comprising a bottom board fraction that is positioned perpendicular to the plane of said terminal bottom board and within a short distance, as compared to a radio signal wavelength of the radio communication terminal, from one end of the loop plane longitudinal element.

10. The built-in antenna according to claim 9, in combination with a mono-pole antenna, the built-in antenna comprising a reception-only antenna element of a diversity antenna and the mono-pole antenna comprising a reception and transmission antenna element of the diversity antenna.

11. The built-in antenna according to claim 9, in combination with a second loop antenna, the built-in antenna comprising a reception-only antenna element of a diversity antenna and the second loop antenna comprising a reception and transmission antenna element of the diversity antenna;

wherein the second loop antenna has a tabular configuration connects to said terminal bottom board and is positioned so that a loop plane of said second loop antenna is perpendicular to the plane of said terminal bottom board;

wherein said second loop antenna connects to said balanced/unbalanced conversion circuit by a feeding end of said second loop antenna;

wherein said terminal bottom board reflects an electromagnetic wave from said second loop antenna in a direction away from the user; and wherein said balanced/unbalanced conversion circuit minimizes an antenna current of said second loop antenna flowing to said terminal bottom board.

12. The built-in antenna for a radio communication terminal according to claim 2, said loop antenna having a loop plane longitudinal element; and said terminal bottom board further comprising a bottom board fraction that is positioned perpendicular to the plane of said terminal bottom board and within a short distance, as compared to a radio signal wavelength of the radio communication terminal, from more than one end the loop plane longitudinal element.

13. The built-in antenna according to claim 12, in combination with a mono-pole antenna, the built-in antenna comprising a reception-only antenna element of a diversity antenna and the mono-pole antenna comprising a reception and transmission antenna element of the diversity antenna.

14. The built-in antenna according to claim 12, in combination with a second loop antenna, the built-in antenna comprising a reception-only antenna element of a diversity antenna and the second loop antenna comprising a reception and transmission antenna element of the diversity antenna;

wherein the second loop antenna has a tabular configuration connects to said terminal bottom board and is positioned so that a loop plane of said second loop antenna is perpendicular to the plane of said terminal bottom board;

wherein said second loop antenna connects to said balanced/unbalanced conversion circuit by a feeding end of said second loop antenna;

wherein said terminal bottom board reflects an electromagnetic wave from said second loop antenna in a direction away from the user; and wherein said balanced/unbalanced conversion circuit minimizes an antenna current of said second loop antenna flowing to said terminal bottom board.

15. The built-in antenna for a radio communication terminal according to claim 2, wherein a longitudinal direction of said loop antenna is tilted approximately 60 degrees in the plane of said terminal bottom board, so that the longitudinal direction of said loop antenna is substantially vertical when the radio communication terminal is in use.

16. The built-in antenna according to claim 15, in combination with a mono-pole antenna, the built-in antenna comprising a reception-only antenna element of a diversity antenna and the mono-pole antenna comprising a reception and transmission antenna element of the diversity antenna.

17. The built-in antenna according to claim 15, in combination with a loop antenna, the loop antenna comprising a reception-only antenna element of a diversity antenna and the built-in antenna comprising a reception and transmission antenna element of the diversity antenna.

18. The built-in antenna according to claim 15, in combination with a second loop antenna, the built-in antenna comprising a reception and transmission antenna element of a diversity antenna and said second loop antenna comprising a reception-only antenna element of the diversity antenna;

wherein said second loop antenna has a longitudinal direction parallel to a body of the user during radio communication, connects to said terminal bottom board and is positioned in the plane of said terminal bottom board;

wherein said second loop antenna connects to said balanced/unbalanced conversion circuit by a feeding end of said loop antenna; and wherein said balanced/unbalanced conversion circuit minimizes an antenna current flowing to said terminal bottom board.

19. The built-in antenna for a radio communication terminal according to claim 2, said loop antenna having a loop plane longitudinal element that is bent at an angle of 90 degrees in a plane parallel to the plane of the terminal bottom board and is positioned on said terminal bottom board.

20. The built-in antenna for a radio communication terminal according to claim 19, said terminal bottom board further comprising a bottom board fraction that is positioned perpendicular to the plane of said terminal bottom board and within a short distance, as compared to a radio signal wavelength of the radio communication terminal, from one end of the loop plane longitudinal element.

21. The built-in antenna for a radio communication terminal according to claim 19, said terminal bottom board further comprising a bottom board fraction that is positioned perpendicular to the plane of said terminal bottom board and within a short distance, as compared to a radio signal wavelength of the radio communication terminal, from more than one end of the loop plane longitudinal element.

22. The built-in antenna according to claim 19, in combination with a mono-pole antenna, the built-in antenna comprising a reception-only antenna element of a diversity antenna and the mono-pole antenna comprising a reception and transmission antenna element of the diversity antenna.

23. The built-in antenna according to claim 19, in combination with a second loop antenna, the built-in antenna comprising a reception-only antenna element of a diversity antenna and the second loop antenna comprising a reception and transmission antenna element of the diversity antenna;

wherein the second loop antenna has a tabular configuration connects to said terminal bottom board and is positioned so that a loop plane of said second loop antenna is perpendicular to the plane of said terminal bottom board;

wherein said second loop antenna connects to said balanced/unbalanced conversion circuit by a feeding end of said second loop antenna, wherein said terminal bottom board reflects an electromagnetic wave from said second loop antenna in a direction away from the user; and wherein said balanced/unbalanced conversion circuit minimizes an antenna current of said second loop antenna flowing to said terminal bottom board.

24. The built-in antenna according to claim 20, in combination with a mono-pole antenna, the built-in antenna comprising a reception-only antenna element of a diversity antenna and the mono-pole antenna comprising a reception and transmission antenna element of the diversity antenna.

25. The built-in antenna according to claim 20, in combination with a second loop antenna, the built-in antenna comprising a reception-only antenna element of a diversity antenna and the second loop antenna comprising a reception and transmission antenna element of the diversity antenna;

wherein the second loop antenna has a tabular configuration connects to said terminal bottom board and is positioned so that a loop plane of said second loop antenna is perpendicular to the plane of said terminal bottom board;

wherein said second loop antenna connects to said balanced/unbalanced conversion circuit by a feeding end of said second loop antenna;

wherein said terminal bottom board reflects an electromagnetic wave from said second loop antenna in a direction away from the user; and wherein said balanced/unbalanced conversion circuit minimizes an antenna current of said second loop antenna flowing to said terminal bottom board.

26. The built-in antenna according to claim 21, in combination with a mono-pole antenna, the built-in antenna comprising a reception-only antenna element of a diversity antenna and the mono-pole antenna comprising a reception and transmission antenna element of the diversity antenna.

27. The built-in antenna according to claim 21, in combination with a second loop antenna, the built-in antenna comprising a reception-only antenna element of a diversity antenna and the second loop antenna comprising a reception and transmission antenna element of the diversity antenna;

wherein the second loop antenna has a tabular configuration connects to said terminal bottom board and is positioned so that a loop plane of said second loop antenna is perpendicular to the plane of said terminal bottom board;

wherein said second loop antenna connects to said balanced/unbalanced conversion circuit by a feeding end of said second loop antenna;

wherein said terminal bottom board reflects an electromagnetic wave from said second loop antenna in a direction away from the user; and wherein said balanced/unbalanced conversion circuit minimizes an antenna current of said second loop antenna flowing to said terminal bottom board.

* * * * *